US010029166B2

(12) United States Patent
Stocchi

(10) Patent No.: US 10,029,166 B2
(45) Date of Patent: Jul. 24, 2018

(54) SINGLE WHEEL SKATE

(71) Applicant: Luca Stocchi, Arezzo (IT)

(72) Inventor: Luca Stocchi, Arezzo (IT)

( * ) Notice: Subject to any disclaimer, the term of this patent is extended or adjusted under 35 U.S.C. 154(b) by 0 days.

(21) Appl. No.: 15/514,899

(22) PCT Filed: Sep. 29, 2015

(86) PCT No.: PCT/IB2015/001947
§ 371 (c)(1),
(2) Date: Mar. 28, 2017

(87) PCT Pub. No.: WO2015/051262
PCT Pub. Date: Apr. 7, 2016

(65) Prior Publication Data

US 2017/0209774 A1 Jul. 27, 2017

(30) Foreign Application Priority Data

Sep. 29, 2014 (IT) ..... VI2014A0251

(51) Int. Cl.
*A63C 17/08* (2006.01)
*A63C 17/14* (2006.01)
(Continued)

(52) U.S. Cl.
CPC ..... *A63C 17/08* (2013.01); *A63C 17/1427* (2013.01); *A63C 17/226* (2013.01);
(Continued)

(58) Field of Classification Search
CPC ..... A63C 17/08
See application file for complete search history.

(56) References Cited

U.S. PATENT DOCUMENTS 5,312,120 A 5/1994 Wiegner
5,951,028 A 9/1999 Lovitt et al.
(Continued)

FOREIGN PATENT DOCUMENTS

CH 108952 6/1925
DE 365513 * 12/1922 ..... A63C 17/01
(Continued)

OTHER PUBLICATIONS

Written opinion issued by the Italian ministry of economics (eqt. to US Dept. of Commerce) in Italian patent application No. VI2014A000251, which is the Italian equivalent of the above-identified US patent application.

*Primary Examiner* — Erez Gurari
(74) *Attorney, Agent, or Firm* — Robert Lelkes

(57) ABSTRACT

The present invention refers to a roller skate with a single wheel comprising a wheel (2110, 2120); a connection means (230) configured so as to allow the connection of a shoe (S); characterized in that the wheel is made up of a first circular element (2110) and a second circular element (2120), inside the first circular element, between which a rolling element (2130) is arranged, configured so as to facilitate the relative movement of the first circular element (2110) with respect to the second circular element (2120); and in that the connection means (230) is connected to the second circular element (2120) and is configured so as to position the shoe (S) at least partially inside the first circular element, preferably in an orientable manner according to any direction with respect to the second circular element (2120).

10 Claims, 13 Drawing Sheets

(51) Int. Cl.
*A63C 17/26* (2006.01)
*A63C 17/22* (2006.01)

(52) U.S. Cl.
CPC ..... *A63C 17/26* (2013.01); *A63C 17/262* (2013.01); *A63C 2017/1472* (2013.01)

(56) References Cited

U.S. PATENT DOCUMENTS

| | | | | |
|---|---|---|---|---|
| 2008/0272567 | A1* | 11/2008 | Chen ..... | A63C 17/01 280/87.042 |
| 2010/0109266 | A1 | 5/2010 | Jenkins | |

FOREIGN PATENT DOCUMENTS

| | | | | |
|---|---|---|---|---|
| FR | 571303 | A | 5/1924 | |
| FR | 753203 | * | 10/1933 | ..... A63C 17/01 |
| FR | 753203 | A | 10/1933 | |

* cited by examiner

SINGLE WHEEL SKATE

TECHNICAL FIELD OF THE INVENTION

The present invention concerns, in general, a roller skate having a single wheel and characteristics thereof adapted for facilitating the use thereof.

STATE OF THE ART

Currently, it is known to use roller skates with multiple wheels, often four wheels in line or in pairs of two wheels on a front axle and two wheels on a rear axle. These two types of known roller skates are then again split into more specific models according to the material and/or size of the wheels and/or shape of the shoe, etc. Despite this, all these types of roller skates suffer from a shared problem dictated by the small size of the wheels, which makes it impossible, or complicated, to use them on surfaces that are not perfectly smooth.

More specifically, a wheel of a common in-line roller skate has a diameter ranging from 6 cm to 8 cm. This makes even the slightest unevenness of the terrain troublesome. A simple stone 1 cm high, or a step of the same size, or furthermore a groove in the terrain like a manhole cover or other, make skating complicated since even objects of such a small size can cause one or more of the wheels of the roller skate to block.

A solution to this problem consists of using larger wheels. In this case, in order to still make the roller skate compact, as the size of the wheels increases the number thereof is decreased. The extreme scenario of this trend, therefore, is a roller skate having a single large wheel. A roller skate 1 according to such a state of the art is known from U.S. Pat. No. 2,980,436 and is schematically illustrated in FIGS. 1A and 1B.

FIG. 1A illustrates a front view of the roller skate, projected on the plane Z-Y parallel to the axis of the wheel of the roller skate, whereas FIG. 1B illustrates a side view of the same roller skate, projected on the plane X-Y parallel to the wheel and perpendicular to the plane Z-Y. As can be seen, the roller skate 1 comprises a wheel 110 and a frame having a vertical part 120 and a horizontal part 130. The frame is connected to the axle 140 of the wheel, so as to allow the rotation of the wheel 110 with respect to the vertical part 120 of the frame. The axis 140 of the wheel is visible, for illustrative purposes since covered by the wheel 110, in the image of front projection 140. The horizontal part of the frame 130 is configured to support the shoe of a user. There is also a fixing element 150 that is used to fix the user's leg to the vertical part 120 of the frame. In this way, the leg is firmly fixed at two points to the frame, so as to allow the roller skate to be controlled.

Such a roller skate, nevertheless, suffers from various problems.

Firstly, since the weight of the user is not positioned on the vertical (direction Y) of the point of contact of the wheel 110 with the ground, a force substantially perpendicular to the plane containing the vertical part 120 of the frame is continuously exerted on the leg of the user. Such a continuous pressure on the leg of the user is painful and/or uncomfortable. Such a force also pushes the roller skate in the direction indicated by the arrow 160, thus causing the contact between the end of the horizontal part 130 and/or of the shoe of the user with the ground. This can be mitigated by using higher wheels, but thus resulting in greater weight of the roller skate. Alternatively, the problem can be mitigated by mounting the frame higher up, in direction Y, with respect to the wheel. Such a solution, however, harms the stability of the user on the roller skate since it raises the point of support of the user with respect to the centre of rotation of the wheel.

Moreover, the positioning of the shoe on the horizontal part 130 of the frame forces the user to use the roller skates outside of the two legs. In other words, since the roller skate extends substantially in direction Z with respect to the wheel, the use of the two roller skates is necessarily outside of the legs, given that internal use of the wheels 110 would force the user to constantly move with legs apart, in an uncomfortable and tiring manner.

In addition, the angle between the leg and the plane containing the wheel is fixed. In fact, if one were to introduce an angle between these two elements it would risk the upper or lower end of the vertical part 120 of the frame making contact with the wheel 110 and/or the horizontal part 130 of the frame making contact with the ground. This limits the possibility of personalization by users having different physiognomy, with legs oriented more or less towards the inside or outside of the body. Such a problem can be partially mitigated by increasing the length of the axis 140, so as to allow the frame to be more or less angled with respect to the plane of the wheel 110, but such an approach does nothing but worsen the problems quoted earlier.

There is also the problem of how to control the movement by the user. In particular, a roller skate like the one illustrated in FIGS. 1A and 1B does not have brakes. The user can of course position the roller skate perpendicularly to the direction of movement, so as to use the wheel as a brake in a similar manner to what happens with conventional roller skates. Such a manoeuvre however requires that the user masters the use of the roller skate, and is very difficult to carry out during the learning step. For this purpose, brake pads are mounted on conventional roller skates, in the area close to the heel and/or the toe of the user's foot, so as to allow the brake to be applied by lifting or lowering the toe of the foot. This, however, is not possible in the roller skate in the figures, since, unlike conventional roller skates where the sole of the foot is always substantially parallel to the ground, the foot is free to rotate with respect to the axis 140 of the wheel 110 at all moments of use of the roller skate. A classical brake pad, positioned at the heel or toe of the user's foot, would therefore constantly result in undesired braking.

Finally, the roller skate 1 does not allow quick fastening and/or release of the roller skate by the user.

SUMMARY OF THE INVENTION

The present invention has the purpose of providing a roller skate with a single wheel that offers easy operation by the user, preferably solving at least one or more of the problems outlined above.

Such a purpose is obtained thanks to a roller skate according to any one of the independent claims.

Advantageous implementations are also described by the dependent claims.

In particular, the present invention can refer to a roller skate (2-10) with a single wheel comprising: a wheel (2110, 2120); a connection means (230) configured so as to allow the connection of a shoe (S); characterized in that the wheel comprises a first circular element (2110) and a second circular element (2120), inside the first circular element, between the first circular element (2110) and the second circular element (2120) a rolling element (2130) being arranged, configured so as to facilitate the relative movement of the first circular element (2110) with respect to the second circular element (2120); and in that the connection means (230) is connected to the second circular element (2120) and is configured so as to position the shoe (S) at least partially inside the first circular element.

In some embodiments, the rolling element (2130) can be balls, rollers, ball bearings or roller bearings.

In some embodiments, the connection means (230) and the second circular element (2120) can be configured so as to position the shoe (S) at least partially inside the second circular element.

In some embodiments, the connection means (230) can be connected through a first configuration means (2710) and/or a second configuration means (2720) to the second circular element (2120), and the first and/or the second connection means can be configured so as to allow a planar movement of the connection means (230) with respect to the second circular element (2120).

In some embodiments, the connection means (230) can be connected through a third configuration means (2760, 2761) to the second circular element (2120), and the third connection means can be configured so as to allow an angular movement of the connection means (230) with respect to the second circular element (2120).

In some embodiments, the roller skate can also comprise a brake (2810, 2820), where the brake can comprise a first braking element (2820) connected to the first circular element (2110) and a second braking element (2810) connected to the second circular element (2120) and the braking action is obtained by the friction between the first braking element and the second braking element.

The present invention can also refer to a roller skating system comprising a roller skate and an actuator for the brake, in which the actuator can be configured so as to be operated remotely, preferably by hand, by the user of the roller skating system.

In some embodiments, the roller skating system can also comprise a rod, preferably used by the user of the roller skating system in order to aid himself/herself during the use of the roller skating system, in which the actuator is mounted on the rod, preferably at one end and/or at a gripping point thereof.

In some embodiments, the roller skate can also comprise a free wheel system, preferably disinsertable, which can include a sawtooth disc (2910) and at least one elastic return stopper (2920, 2930).

In some embodiments, the sawtooth disc (2910) and the first braking element (2820) can be made from a single element.

In general, the present invention solves the problem of the stability of the roller skate thanks to a construction similar to that of a bearing, with a first outer circular element, and a second inner circular element. Thanks to this construction, the space inside the second circular element is empty, unlike the state of the art, in which such a space is occupied by the spokes of the wheel. Thanks to this it is possible to position the shoe, at least partially, inside the plane of the wheel, in particular at least partially inside the first circular element, and not at the side with respect to it. In this way, the weight of the user is discharged substantially, or at least partially, on the vertical of contact between wheel and ground, and not at the side with respect to such a point, thus avoiding the problems concerning the state of the art, in particular avoiding or reducing the movement according to the direction 160. It will be clear that in order to obtain such an advantage it is not necessary for the shoe to be entirely arranged inside the wheel, with it being sufficient for the position of the shoe to allow the weight, or at least part of the weight, of the user to be discharged on the vertical of contact between the ground and the wheel. The present invention is therefore applicable also in the case in which the shoe is totally contained inside the wheel or is outside of it. It will also be clear that the term "inside the wheel" or "inside the first or second circular element" when referring to the shoe should not be interpreted as if the shoe is an internal part of these components, but it should be interpreted in the sense that the shoe is positioned so as to intersect the plane defined by the wheel, or by the first or second circular element. The term "inside the wheel" or "inside the first or second circular element" is therefore the same that could be used in the case of a rim of a bicycle wheel that is indeed positioned "inside the wheel", or "inside the tyre of the wheel".

The other problems relative to the state of the art are also solved by additional embodiments, in particular thanks to the presence of a brake and/or of a free wheel and thanks to their configuration and control, preferably remotely.

BRIEF DESCRIPTION OF THE FIGURES

The invention will be described in greater detail exclusively as an example, using advantageous embodiments and with reference to the figures. The embodiments described are only possible configurations in which the single characteristics can nevertheless, as described above, be implemented independently from one another or they can be omitted. Elements that are the same illustrated in the figures are marked with the same reference numerals. Parts of the description relative to elements that are the same illustrated in the different figures can be left out. In the figures.

DETAILED DESCRIPTION OF THE INVENTION

Figure 2A:
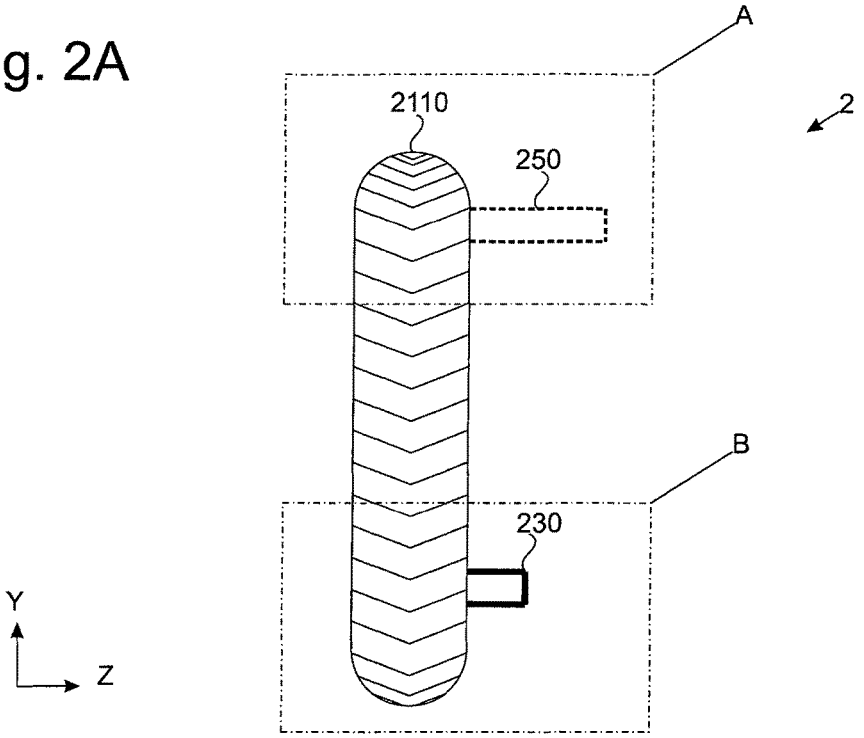
FIGS. 2A and 2B schematically illustrate a roller skate according to an embodiment of the present invention.
Figure 2B:
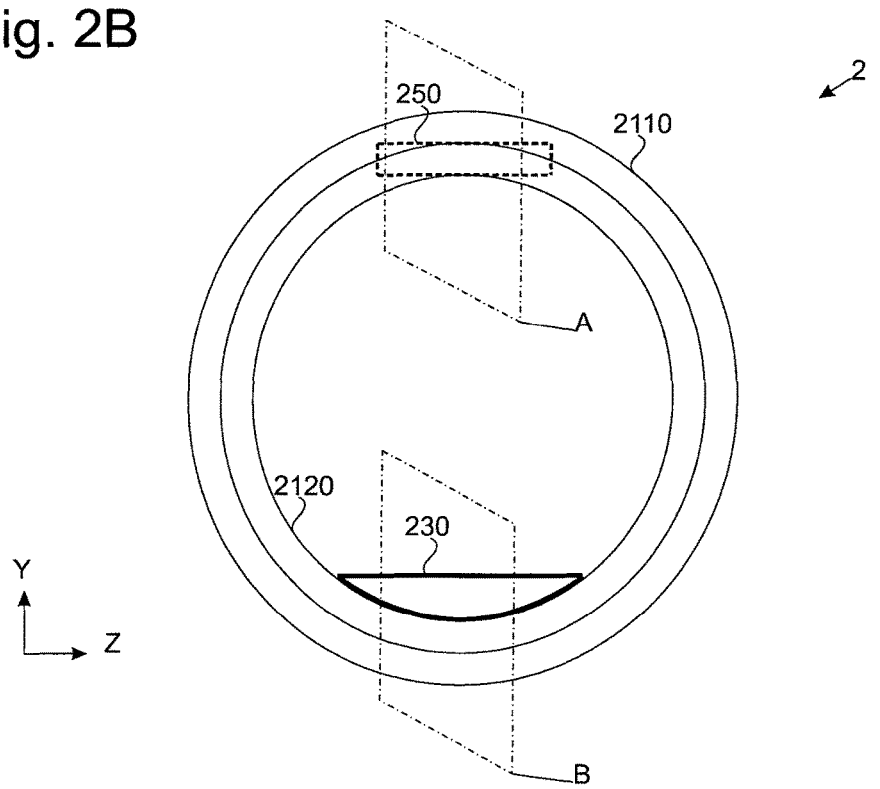

FIG. 2A schematically illustrates a roller skate 2 according to an embodiment of the invention projected on the plane Z-Y containing the axis of the wheel of the roller skate whereas FIG. 2B illustrates a side view of the same roller skate projected on the plane X-Y parallel to the plane containing the wheel and perpendicular to the plane of FIG. 2A.

Figure 3A:
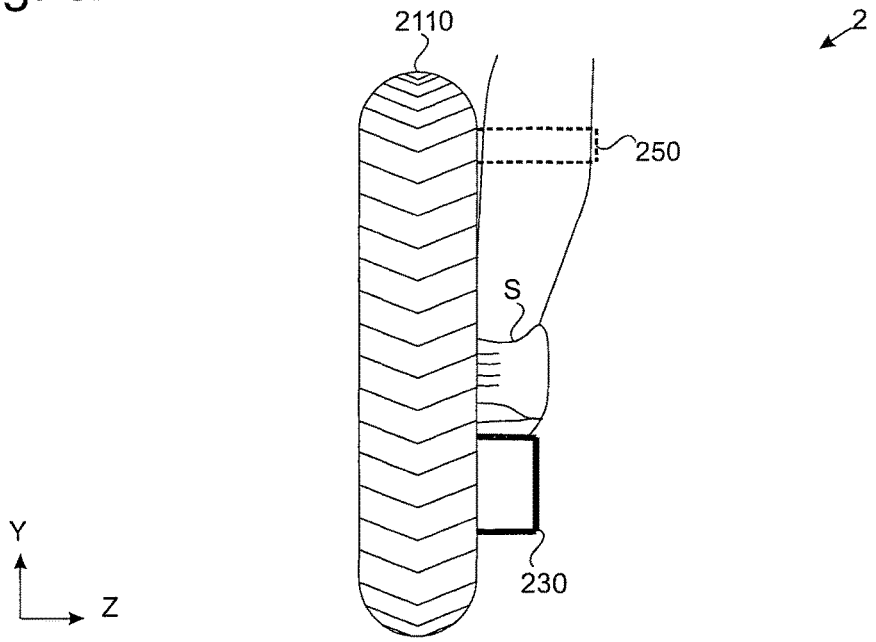
FIGS. 3A and 3B schematically illustrate the roller skate of FIGS. 2A and 2B during use.
Figure 3B:
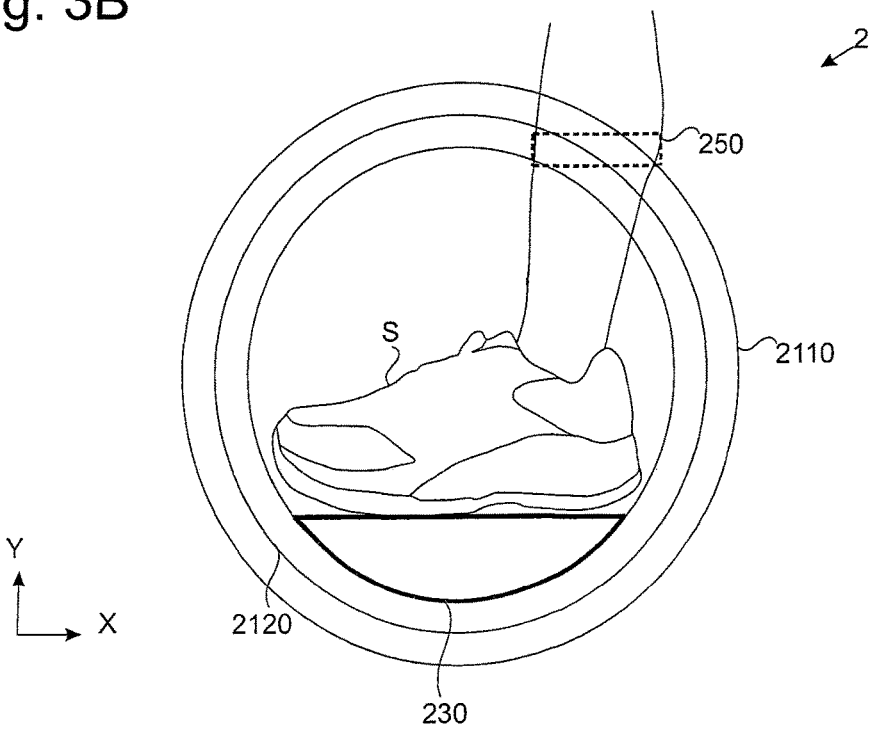

As can be seen in FIG. 2A, the roller skate 2 comprises a wheel comprising a first circular element 2110 and a second circular element 2120, inside the first circular element 2110. In a preferred embodiment, the second circular element 2120 is of a size such as to allow the presence of at least part of a shoe S of the user, in the direction of the length thereof, inside the second circular element 2120 in direction X, as illustrated in FIGS. 3A and 3B. In particular, the second circular element 2120 has an outer diameter substantially equal to the internal diameter of the first circular element 2110, with a difference between the two diameters such as to allow the movement of one with respect to the other, and/or the insertion of a rolling element, in the case in which the rolling element is not built into the first and/or second circular element. It is clear that the shoe S can be greater in size than the second circular element, in this case at least part, for example the toe or the heel, of the shoe S will be external, in direction Z or will be higher in direction Y, with respect to the second circular element 2120.

Between the first and the second circular element there is a rolling element, not illustrated, configured so as to facilitate the relative movement of the first circular element 2110 with respect to the second circular element 2120. In an embodiment the rolling element could be a series of balls, or of rollers, in contact with the first circular element 2110 and the second circular element 2120, in a configuration similar to a ball or roller bearing.

The roller skate 2 also comprises a connection means 230, connected to the second circular element 2120 and, optionally, a stabilization means 250, configured so as to be connected to the leg of the user. The connection of the connection means 230 and/or of the stabilization means 250 to the second circular element 2120 can be carried out with screws, nuts and bolts, glue, fusion, welding, magnets, etc. or quick fastening systems similar to or the same as those used in connections between bicycle pedals and bicycle shoes. Alternatively, the different elements can be obtained in a single physical component.

The connection means 230 can be a platform that allows a user to rest his/her shoe or, in more complex embodiments, it can allow more advanced functions of orientation of the platform and/or connection to the shoe. Such embodiments will be described hereinafter.

Such a configuration allows the connection means 230 to be advantageously positioned with respect to a roller skate according to the state of the art. In particular, the two circular elements 2110 and 2120 allow a roller skate to be obtained without the presence of spokes or other elements inside the wheel, unlike the case illustrated in FIGS. 1A and 1B. Thanks to the space thus formed, the connection means 230 can be advantageously positioned closer to the vertical (direction Y) containing the point of contact of the wheel with the ground. In other words, the connection element 230 can be positioned in a manner vertically more aligned with the plane of the wheel. Such a position thus allows the thrust of the roller skate in the direction 160 illustrated in FIG. 1A to be substantially attenuated. Thanks to this, the roller skate is simpler and more comfortable to use. This also makes it possible, in some embodiments, to eliminate the stabilization means 150 of the roller skate 1. In fact, by reducing the tendency of the roller skate to move in the direction 160, the user is able to keep the roller skate in vertical position with the use of a shoe fixedly connected with the connection means 230, even only thanks to the force of his/her ankle or with the use of a light shoe with rigid ankle part in the direction 160. Thanks to the aforementioned simplifications, the roller skate is also lighter and easier and more cost-effective to produce.

It will be clear that, in order to obtain the advantages described above, it is not necessary for the connection means to be connected above the second circular element 2120. So long as the connection means allows a positioning of the shoe of the user such as to position the weight of the user close to the vertical passing through the point of contact of the wheel with the ground, the advantages described above can be obtained. It will therefore be possible to make, for example, a connection means 230 connected to the second circular element 2120 outside of the plane of the wheel and then curved towards the inside of the roller skate, therefore towards the plane of the wheel, so as to advantageously position at least part of the shoe S inside, or in any case close to, the plane X-Y containing the wheel, or in other words inside the wheel itself. Again as an example, the connection means could remain positioned outside the plane X-Y of the wheel but be configured so as to position the shoe S at least partially inside the aforementioned plane. Such a configuration could be obtained, for example, by using a shoe having a sole that is not deformable and laterally connected to a connection means 230 having a vertical shape and positioned proximally to the plane X-Y of the wheel. In this way, although the connection means 230 is not, per se, inside the plane X-Y of the wheel, its configuration allows the shoe to be positioned at least partially inside this plane, or at least partially inside the wheel, or at least partially inside the first circular element, so as to advantageously position the weight of the user above, or close to, the vertical of the resting point of the wheel, and in particular of the first circular element, with the ground.

Although in FIG. 2A the connection means 230 is illustrated as made with asymmetrical lateral positioning with respect to the plane X-Y containing the wheel, in particular extending in direction Z, the present invention is not limited to this configuration. Alternatively, the connection means 230 could extend symmetrically with respect to the centre of the wheel on both sides thereof, or it could extend more in the negative direction Z. It will also be clear that the connection means 230 is illustrated in FIG. 2B only schematically, and in particular as completely contained in the direction X inside the second circular element 2120. In some embodiments, the part of the connection means 230 outside, in direction Z, the second circular element 2120 can be widened in direction X in its part outside the wheel, so as to allow greater support for the shoe S of the user.

In general, by allowing at least one part of the shoe, for example one side thereof, to be inside the plane containing the wheel, it is possible to arrange the barycentre of the weight transferred from the shoe as close as possible to said plane, and therefore as close as possible to the vertical of the support point of the first circular element on the ground, so as to avoid the movement according to the direction 160, suffered by the state of the art.

In an optional manner, a stabilization means 250 can be foreseen, connected to the second circular element 2120. The stabilization means 250 could be made, for example, with a belt and a buckle, and/or with an elastic band and/or a velcro system and/or a magnetic system. The stabilization means 250 makes it possible to fix the leg of the user so as to avoid any excessive stress on the ankle.

Figure 4A:
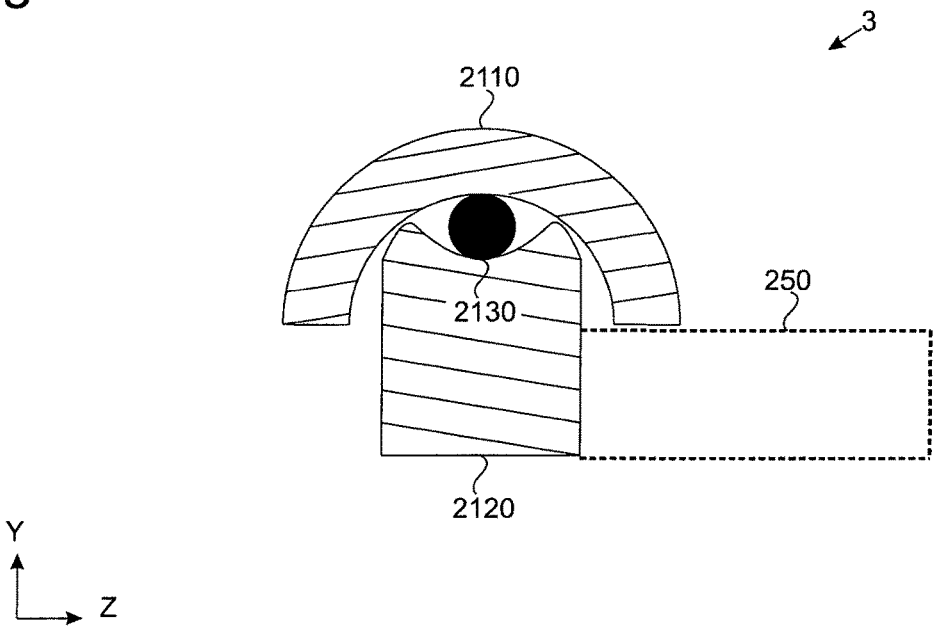
FIGS. 4A and 4B schematically illustrate a roller skate having balls that allow the rotation of the roller skate, according to an embodiment of the present invention.
Figure 4B:
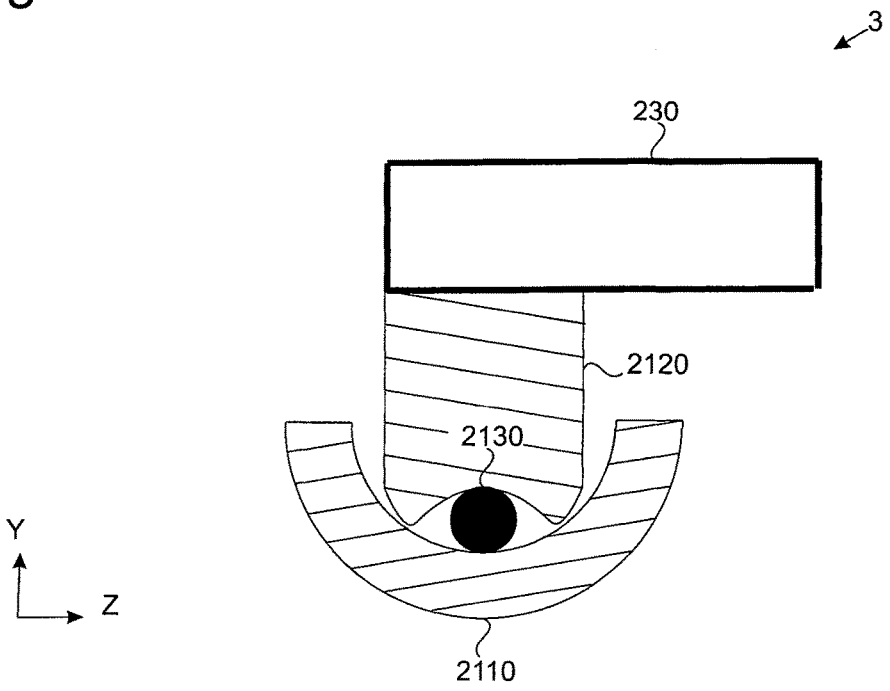

FIG. 4A schematically illustrates an upper section of a roller skate 3 according to an embodiment of the invention sectioned by the plane Z-Y parallel to the axis of the wheel whereas FIG. 4B schematically illustrates a lower section of the roller skate 3 sectioned by the same plane Z-Y. In particular FIGS. 4A and 4B correspond, respectively, to the sections of the regions indicated by the rectangles A and B in FIGS. 2A and 2B.

As can be seen in FIG. 4A, the upper section of the roller skate 3 comprises the first circular element 2110 that could, for example, be a wheel made or covered with an adhesive surface, like, for example, rubber. The same circular element 2110 is also present in the lower section of the roller skate 3, illustrated in FIG. 4B. Even if not illustrated, it will be clear that the first circular element 2110 could have a more complex structure, adapted to provide strength and comfort in use. For example, a metallic support can be made inside the circular element 2110, cooperating with an outer structure made from rubbery material, potentially arranging an air chamber, or material suitable for absorbing roughness, between these two elements, in an analogous way to a wheel of a bicycle. In addition, the second circular element 2120 is present both in the upper section illustrated in FIG. 4A, and in the lower section of FIG. 4B. The second circular element 2120 could be made, for example, of metal or plastic.

A possible shape of the first and second circular element is illustrated in the sections in FIGS. 4A and 4B and allows an example to be provided of how the space defined between the first and second circular element allows the insertion of balls 2130 having the function of a rolling element. It will be clear, in possible alternatives, that with different shapes of the circular elements 2110 and 2120 it will be possible to define a space adapted to contain, for example, rollers as rolling elements.

Finally, in the upper section of the roller skate 3, illustrated in FIG. 4A, the stabilization means 250 is illustrated as connected to the second circular element 2120. In an analogous manner, in FIG. 4B illustrating the lower section of the roller skate 3, the connection means 230 is connected to the second circular element 2120.

Figure 4C:
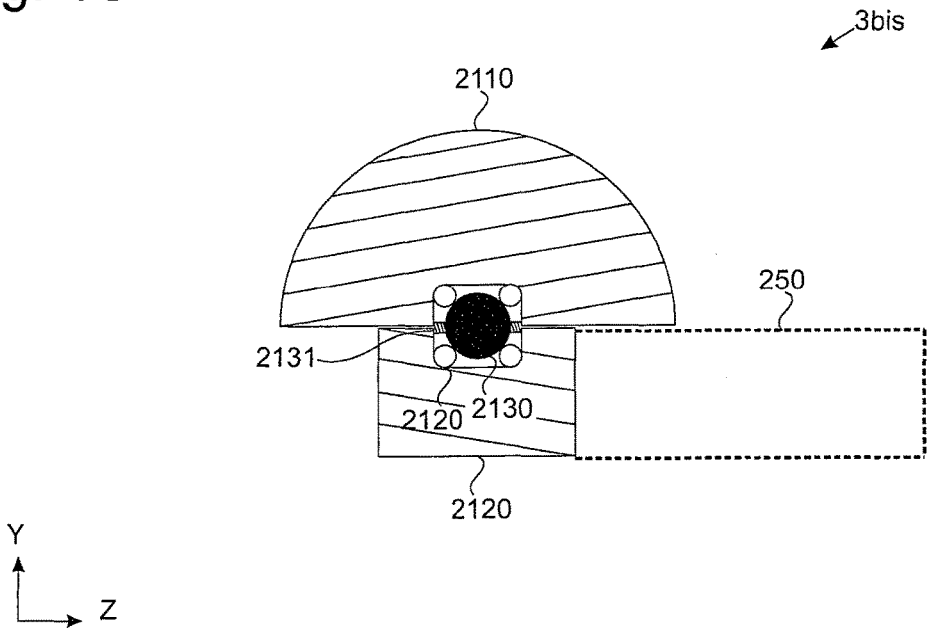
FIGS. 4C and 4D schematically illustrate a roller skate having a ball bearing that allows the rotation of the roller skate, according to an embodiment of the present invention.
Figure 4D:
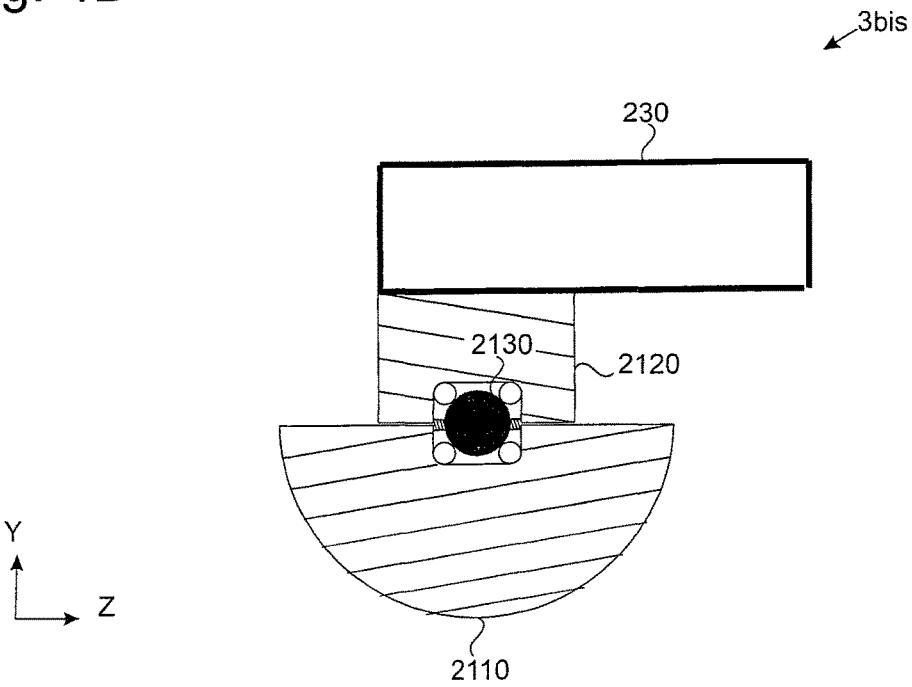

FIG. 4C schematically illustrates an upper section of a roller skate 3*bis* according to an embodiment of the invention sectioned by the plane Z-Y parallel to the axis of the wheel whereas FIG. 4D schematically illustrates a lower section of the roller skate 3*bis* sectioned by the same plane Z-Y. In particular, FIGS. 4C and 4D correspond, respectively, to the sections of the regions indicated by the rectangles A and B in FIGS. 2A and 2B.

In the roller skate 3*bis*, a possible alternative shape of the first and second circular element is illustrated in the sections in FIGS. 4C and 4D. In this embodiment, the space defined between the first and second circular element allows the insertion of balls 2130 organised in a bearing. In particular, the balls 2130 are contained in a suitable cage 2131, which ensures the separation thereof, reducing friction, and slide on four runways 2132. Thanks to such a structure, the rolling takes place between the balls 2130 and the four rings forming the runways 2132, generating a minimum friction. The geometry with four points of contact also allows the bearing to support loads coming from every direction.

With such a structure, the first and/or second circular element can advantageously be made of plastic, for example nylon doped with carbon, to act as a support for the bearing.

Figure 5A:
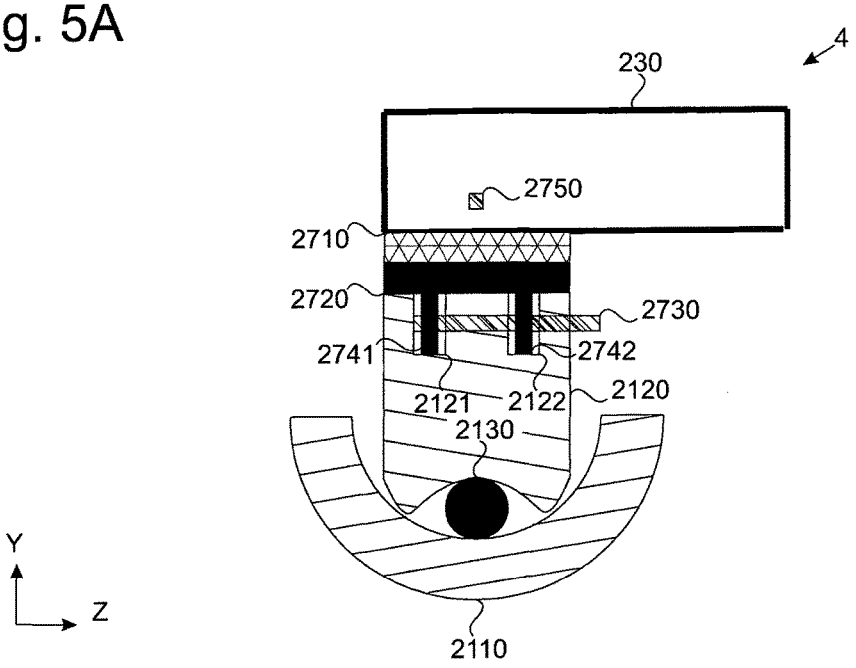
FIGS. 5A and 5B schematically illustrate a roller skate having an adjustable planar position of the shoe, according to an embodiment of the present invention.
Figure 5B:
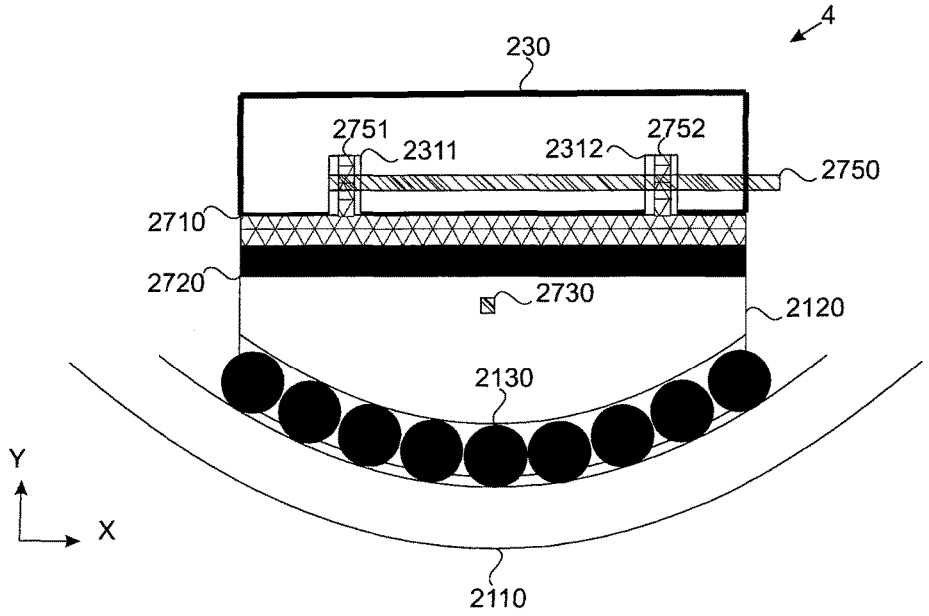

FIG. 5A schematically illustrates a lower section, in an analogous manner to FIG. 4B, of a roller skate 4 according to an embodiment of the invention whereas FIG. 5B schematically illustrates a lower section of the roller skate 4 sectioned by the plane X-Y parallel to the wheel and perpendicular to the plane of FIG. 5A.

As can be seen in FIG. 5A, the roller skate 4 comprises a connection means 230 and other means that allow a connection thereof that can be configured to the second circular element 2120. In particular, thanks to a first configuration means 2710, like for example a plane, and a second configuration means 2720, like for example another plane, it is possible to modify the position of the connection means 230 with respect to the second circular element 2120 in the plane X-Z, both in direction X and in direction Z. In other words, thanks to the addition of at least one configuration means, the relative position of the connection means 230 with respect to the second circular element 2120 can be modified, so as to best adapt to requirements, and/or to the physiognomy, and/or to the use of each single user.

More specifically, in the embodiment illustrated in FIGS. 5A and 5B, the first configuration means 2710 can be substantially a plane of a material with a strength such as to offer a reliable mechanical connection between the connection means 230 and the second configuration means 2720. The first configuration means 2710 comprises two slide rails 2751, 2752 that extend in direction Z in the plane X-Z, inside two sliding guides 2311, 2312 of the connection means 230. The number of slide rails 2751, 2752 and sliding guides 2311, 2312 is illustrated as equal to two for a simple example and it will be clear how a larger or smaller number can be selected as an alternative. Thanks to the sliding of the slide rails 2751, 2752 inside the sliding guides 2311, 2312, the relative position of the connection means 230 with respect to the first configuration means 2710 can be changed along the direction Z.

In an analogous manner, the second configuration means 2720 is essentially a plane of material with a strength such as to offer a reliable mechanical connection between first configuration means 2710 and the second circular element 2120. The second configuration means 2720 comprises two slide rails 2741, 2742 that extend in direction X in the plane X-Z, inside two sliding guides 2121, 2122 of the second circular element 2120. Also in this case, the number of slide rails and sliding guides is equal to two for a simple example and it will be clear how a larger or smaller number can be selected as an alternative. Thanks to the sliding of the slide rails 2741, 2742 inside the sliding guides 2121, 2122, the relative position of the second circular element 2120 with respect to the second configuration means 2720 can be changed along the direction X.

Thanks to two fastening pins 2730, 2750 it is possible to block the sliding of the rails inside the respective guides, so as to block the relative position of the connection means 230 with respect to the second circular element 2120. When the pins, which could be configured so as to have an elastic resistance to their extraction so as to avoid accidental extraction thereof, are extracted, the two elements 230 and 2120 are movable with respect to one another in the plane X-Z. When the pins are inserted, the position selected by the user is advantageously blocked.

It will be clear that the guides and the slide rails can be reversed. For example, the sliding guides 2311, 2312 could be made in the first configuration means 2710 instead of in the connection means 230, and the slide rails 2751, 2752 vice-versa. It will also be clear that the first and the second configuration means can be joined in a fixedly connected manner or made in a single component. Finally, it will be clear that even only one of the two configuration means 2710, 2720 can be present, in the case in which the movement of the connection means 230 is preferable only according to one of the directions X or Z.

Figure 6A:
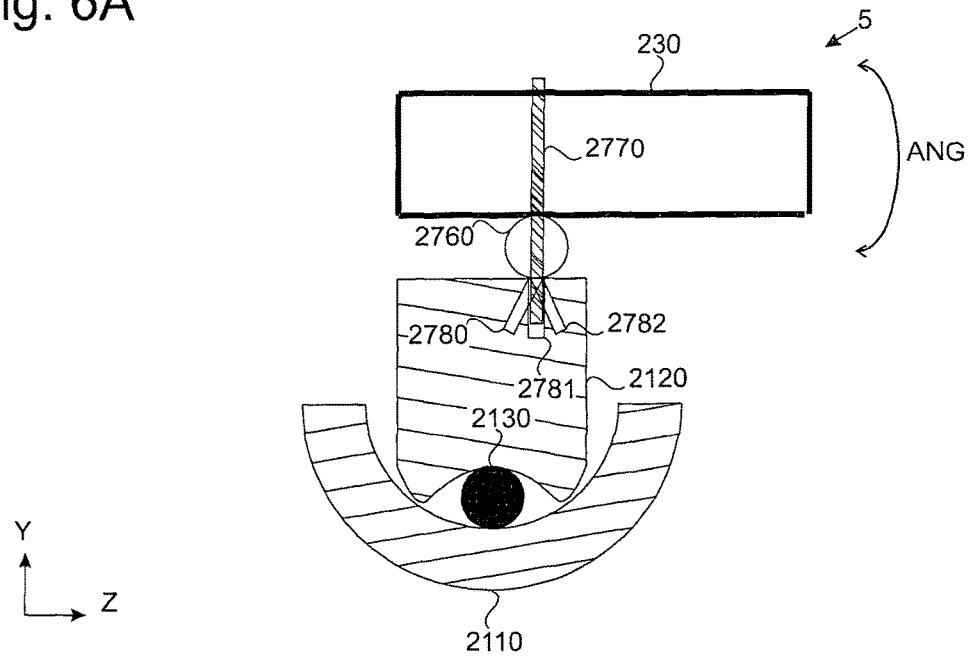
FIGS. 6A and 6B schematically illustrate a roller skate having an adjustable angular position of the shoe, according to an embodiment of the present invention.
Figure 6B:
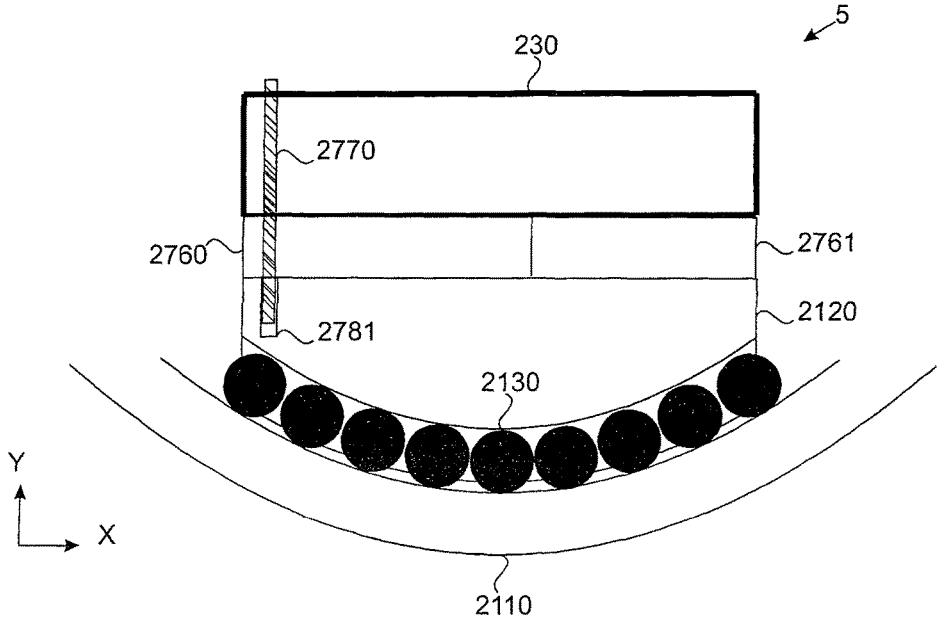

FIG. 6A schematically illustrates a lower section of a roller skate 5 according to an embodiment of the invention sectioned by the plane Z-Y, in an analogous manner to FIG. 5A, whereas FIG. 6B schematically illustrates a lower section of the roller skate 5 sectioned by the plane X-Y, in an analogous manner to FIG. 5B.

As can be seen in FIG. 6A, the roller skate 5 comprises the connection means 230 and components that allow a connection thereof that can be configured to the second circular element 2120. In particular, thanks to a third configuration means 2760, 2761, like for example two substantially circular elements, connected in a rotatable manner with respect to one another and respectively connected one to the connection means 230 and one to the circular element 2120, it is possible to modify the angular position of the connection means 230 with respect to the plane X-Z (or X-Y) as schematically represented by the double arrow ANG. In other words, thanks to the addition of a third configuration means 2760, 2761, the angular position of the connection means 230 with respect to the second circular element 2120 can be modified, so as to best adapt to requirements, and/or to the physiognomy, and/or to the use of each single user. For example, according to the angle formed by the leg of the user with the vertical Y, or depending on the shape of the sole of the foot of the user, the connection means 230 can be rotated towards the inside or outside of the roller skate 5, so as to provide a comfortable position for the user. In addition, or alternatively, the position of the connection means 230 can be modified so as to allow use inside or outside the legs of the roller skate 5. In addition, or alternatively, the position of the connection means 230 can be modified so as to allow different skating styles; as an example, a roller skate more aligned with the vertical Y can be more stable and potentially more suitable for high-speed use than a roller skate more aligned in direction Z, which could be preferable for a more artistic and less high-speed use of the roller skate 5.

More specifically, in the embodiment illustrated in FIGS. 6A and 6B, the third configuration means 2760, 2761 is essentially made up of an element 2760, metallic or of material with a strength such as to offer a reliable mechanical connection between the connection means 230 and the element 2760, and an element 2761, metallic or of material with a strength such as to offer a reliable mechanical connection between the second circular element 2120 and the element 2761. The first angular configuration element 2760 and the second angular configuration element 2761 are connected to one another, in a manner not illustrated, so as to prevent them from moving apart from one another in the direction X, but so as to allow a rotation of one with respect to the other, with respect to its own longitudinal axis. Moreover, thanks to the presence of at least two holes 2780, 2781, 2782 in the second circular element 2120 and a fastening pin 2770 passing through the connection element 230, the angular configuration element 2760 and one of the holes, it is possible to block the angular position of the connection means 230 and of the second circular element 2120.

It will be clear that the present configuration is only one possible example of implementation and alternatives, which allow the angular movement of the connection means 230 with respect to the second circular element 2120 can be considered. For example, the holes 2780-2782 can be made in the connection means 230 instead of in the second circular element 2120. Alternatively, or in addition, it is possible to modify the angle between the second circular element 2120 and the connection means 230 using two vertical supports placed between these two elements, and configured so that the height of at least one of these two supports can be modified with respect to the other. By doing this, a support on one side will be lower than on the other side, therefore resulting in the introduction of an angle between the connection means 230 and the second circular element 2120.

It will also be clear that, with analogous systems, it is possible to modify the angle between the connection means 230 and the second circular element 2120 not only with respect to the axis X, but also, or only, with respect to the axis Z. In other words, it will be possible to modify the inclination of the shoe S in the inside-outside direction to the vertical axis of the roller skate, but also, or only, in the toe-heel direction of the shoe S.

Such an angular configuration, potentially in addition with one or more configurations as described for the roller skate 4, allows a level of configuration such as to best adapt, for every use and user, the position of the connection means 230, and therefore the position of the shoe S of the user, with respect to the roller skate.

Figure 7A:
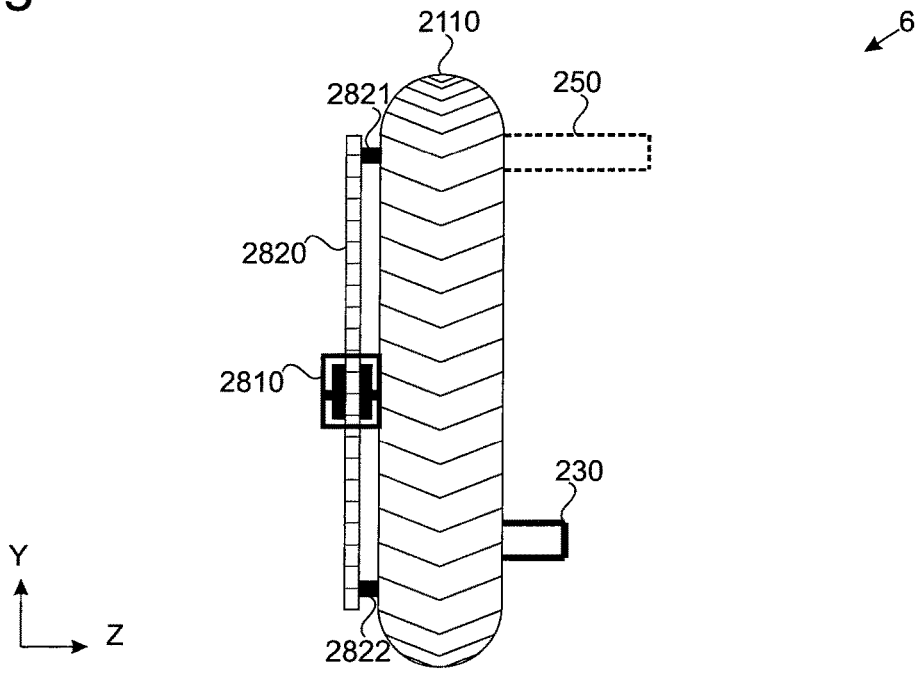
FIGS. 7A and 7B schematically illustrate a roller skate having a brake, according to an embodiment of the present invention.
Figure 7B:
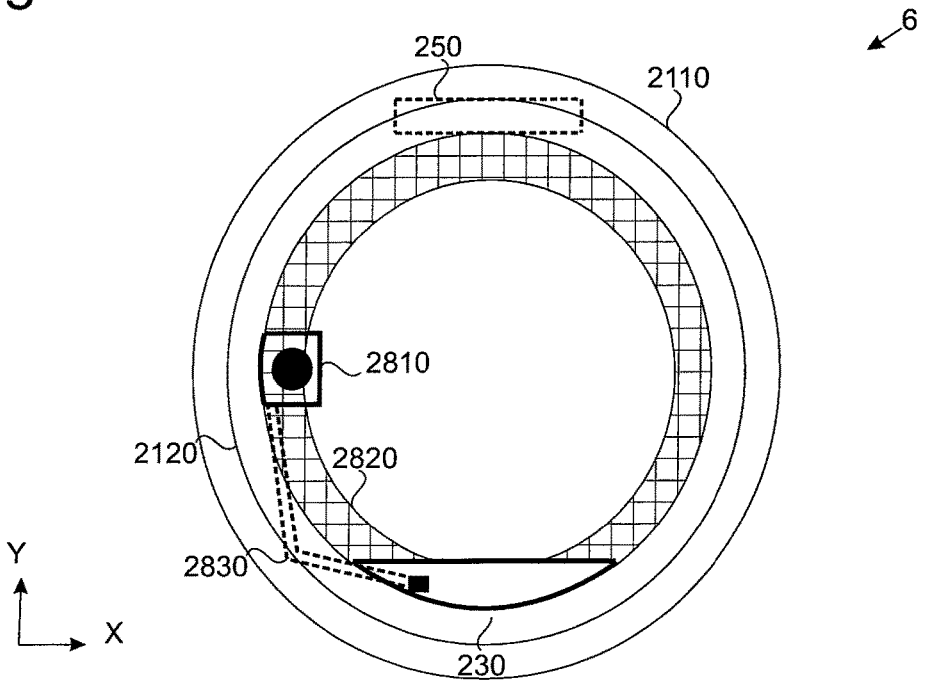

FIG. 7A schematically illustrates a front view of a roller skate 6, according to an embodiment of the invention, projected on the plane Z-Y containing the axis of the wheel of the roller skate whereas FIG. 7B illustrates a side view of the same roller skate projected on the plane X-Y parallel to the plane containing the wheel and perpendicular to the plane of FIG. 7A.

The roller skate 6 comprises a brake for example made from a disc 2820 and a caliper 2810. Thanks to the brake, it is possible to brake the roller skate. Such a construction is particularly advantageous since it allows braking independently from the position of the connection means 230 with respect to the ground, and therefore independently from the position of the shoe S of the user. In fact, the braking through rear or front brake pad, as is common with in-line roller skates or classic roller skates (with pairs of two front and rear wheels) is not feasible in the roller skate of the invention since, contrary to known roller skates, in the present invention the shoe S of the user is not forced to remain in a substantially horizontal position with respect to the ground. This problem is solved by mounting a brake on the roller skate itself, which does not require direct interaction between the braking means, here the caliper, and the ground.

In particular, the disc 2820 is mounted in a manner fixedly connected with the first circular element 2110 through, for example, fasteners schematically illustrated as 2821 and 2822, positioned on one side of the first circular element 2110 and connected to the disc 2820. Thanks to such construction, the disc 2820 rotates substantially as a unit with the first circular element 2110. The caliper 2810 is mounted in a manner substantially fixedly connected with respect to the second circular element 2120. This can be obtained by mounting the caliper 2810 directly on the second circular element 2120 through screws, glue or similar, or by making the jaw of the caliper in a single structure with the second circular element. Alternatively, the caliper 2810 can be mounted in a fixedly connected manner on the connection means 230. In the second case, if the caliper were to be a hindrance to the positioning of the shoe S, it will be possible to make a structure that, mounted on the connection means in a manner such as to avoid inconvenience to the shoe of the user, extends up to a point along the disc 2820 distant enough from the connection means 230 so as not to be in the region able to be occupied by the shoe S of the user. An example of such an optional structure is illustrated schematically with a dashed line in FIG. 7B only, and indicated by reference numeral 2830.

The brake can be controlled remotely through a transmission means of the braking force (not illustrated) adapted to control the operation of the caliper 2810. Such control also allows the brake to be controlled by hand by the user, and therefore with greater precision. The brake can be mounted on a single roller skate, in order to simplify the construction of the set of roller skates and limit the costs, or on both. In the case in which it is mounted on both, the transmission means of the braking force can be a single means connected to both of the roller skates, so as to control both brakes with a single command, or both of the brakes with each of the two commands or a transmission means of the braking force for each brake. In the first two cases, the system could be equipped with a braking balancing mechanism so that each roller skate brakes exactly with the same power. In the case in which the transmission means is hydraulic, to brake both with the same power the hydraulic fluid can be made to flow in a single tube before dividing it to make it arrive at both wheels, so as to balance the pressure that arrives on each caliper.

Although in FIGS. 7A and 7B the braking system comprises a caliper 2810 mounted on the second circular element 2120 and a disc mounted on the first circular element 2110, the present invention is not limited to this implementation. Alternatively, these two elements could be reversed, in particular, the caliper 2810 could be mounted on the first circular element 2110 and the disc 2820 could be mounted on the second circular element 2120. It will be clear that, for the action of the brake, it is sufficient for a braking element between caliper and disc to be mounted in a substantially fixed manner relative to the first circular element and the other braking element between caliper and disc to be mounted in a substantially fixed manner relative to the second circular element and/or relative to the connection means 230. The caliper or the disc or both can also be floating, so as to allow a relative movement with respect to one another in the direction perpendicular to the plane of the disc of the brake so as to compensate for possible lacks of coplanarity between surface of the disc and friction surfaces of the caliper of the brake.

Although in FIGS. 7A and 7B the braking system is a disc and caliper system, the present invention is not limited to this implementation. Alternatively, a brake system with a pad could be used, in a similar manner to the wheel of a bicycle, by making the pad fixedly connected with the second circular element 2120 act, for example, on the first circular element 2110.

Figure 8:
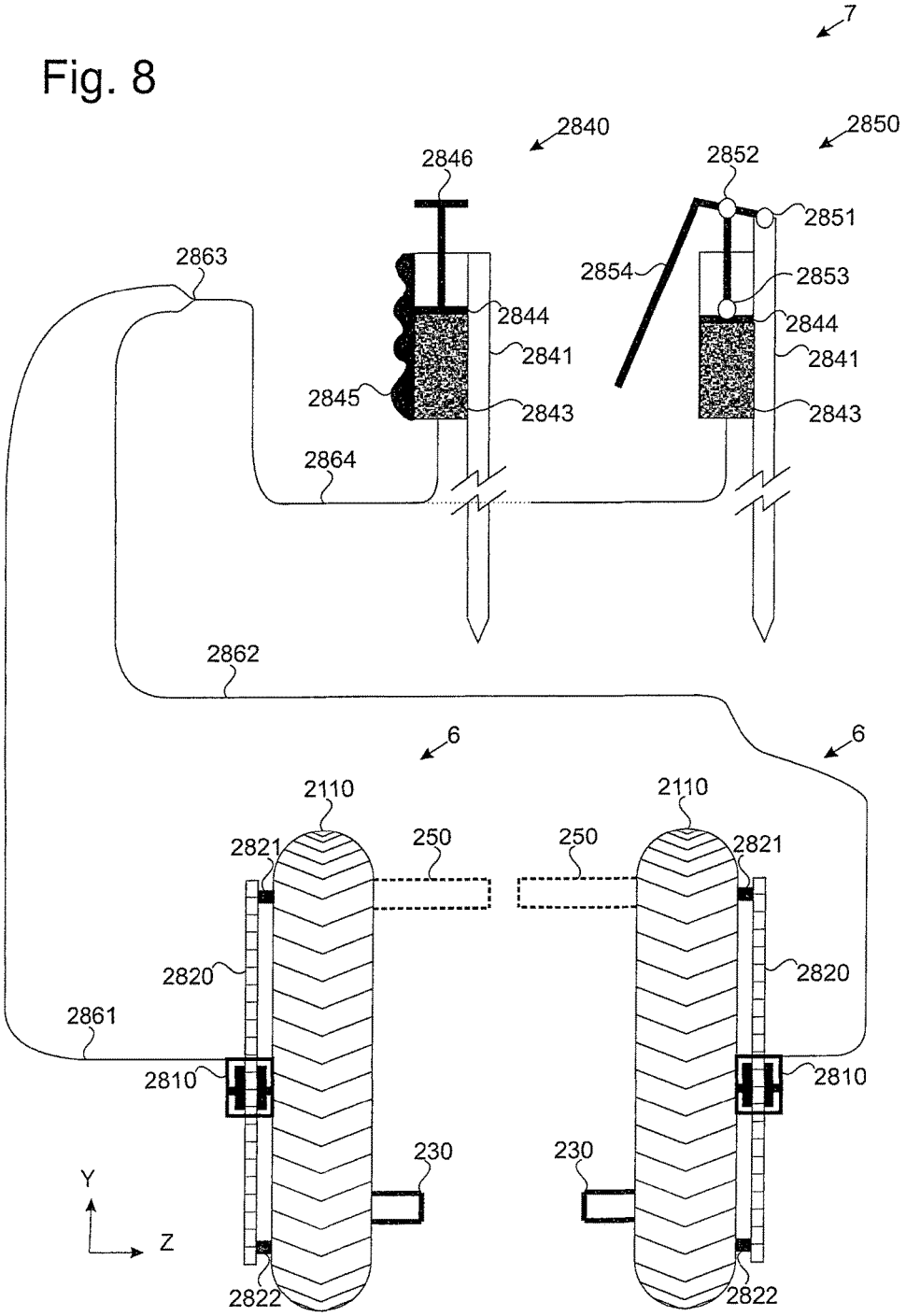
FIG. 8 schematically illustrates a roller skating system comprising a roller skate and an actuator for braking the roller skate, according to an embodiment of the present invention.

An example of a roller skating system is illustrated in FIG. 8. In this particular example, two roller skates 6 share a single transmission means of the braking force.

In particular, in FIG. 8 it is possible to see two roller skates 6, both with a caliper 2810 connected to a transmission means of the braking force 2861, 2862. The two transmission means of the braking force 2861, 2862 are connected through a joint 2863 to a single transmission means of the braking force 2864. As stated above, this is only one possible implementation and the two transmission means of the braking force 2861, 2862 could instead be operated independently. The transmission means of the braking force 2861, 2862, 2864 could, for example, be hydraulic ducts filled with brake oil, or similar.

Again in FIG. 8 two possible actuators 2840, 2850 are illustrated, schematically, both connected to the transmission means of the braking force 2864. It will be clear that the two actuators 2840, 2850 are illustrated in the same figure for the sake of ease of illustration and that, in practice, a single actuator will be sufficient for each transmission means of the braking force to be operated. The actuators 2840, 2850 are two possible examples of actuators having two alternative configurations.

Both of the actuators 2840, 2850 contain a cylinder 2843 containing a liquid, for example oil for disc brakes, and a piston 2844 acting on the liquid. Through the pressure of the piston on the liquid, it is possible to exert a braking force according to known methods. Both of the actuators 2840, 2850 are optionally assembled on a rod 2841, in an advantageous implementation in which it is helpful for the user to use one or more rods, for example trekking or ski rods, to keep his/her balance. It will be clear that the presence of the rod is nevertheless optional and the actuator 2840, 2850 could be made without any rod.

The actuator 2840 is configured to be used through the user pressing his/her thumb on the button 2846. Such use is optionally facilitated by a handgrip 2845.

The actuator 2850 is configured to be used in a similar manner to a brake lever of a bicycle or motorcycle. The actuator 2850 comprises a lever 2854 and a system of levers and pins 2851, 2852, 2853 that allow the movement of the lever 2854 to be transformed, in a direction practically parallel to Z, into a movement of the piston 2844, in a direction practically parallel to Y.

It will be clear that the two actuators 2840, 2850 are only two possible examples and that the present invention is not limited to this. As an alternative, other hydraulic actuators can be implemented, or actuators operating in different ways, like for example a mechanical actuator operating a metallic wire in an external sheath, in a similar manner to the brake of a bicycle.

In some embodiments, the brake can be temporarily blocked, so as to always be inserted, so as to use the roller skate without it be possible to rotate. This can be useful, for example, during the learning phase to allow the user to become familiar with the position on the roller skate, without the additional difficulty due to the free movement of the wheel.

Such a functionality can be obtained, for example, using an elastic band or a stopper (both not illustrated) acting on the actuator, so as to block the actuator in the braked position. Alternatively, for example in the case of a hydraulic system, it is possible to insert a non-return valve, able to be controlled so as to be activated or deactivated. When the non-return valve is activated, with a pressure on the actuator, the liquid in the braking system will be put under pressure, which will remain under pressure thanks to the action of the non-return valve.

In a variant, the blocking of the brake can be carried out at the level of the caliper 2810. Such a variant is advantageous since it does not force the user to hold the actuator system of the brake and/or the relative rods in hand, during the learning phase.

Figure 9A:
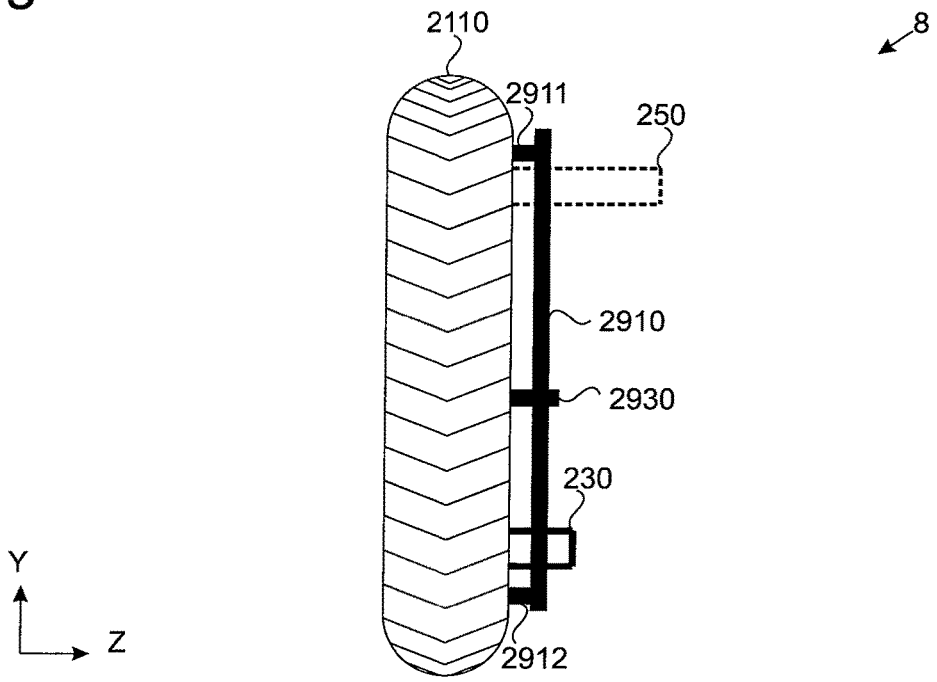
FIGS. 9A and 9B schematically illustrate a roller skate having a free wheel system, according to an embodiment of the present invention.
Figure 9B:
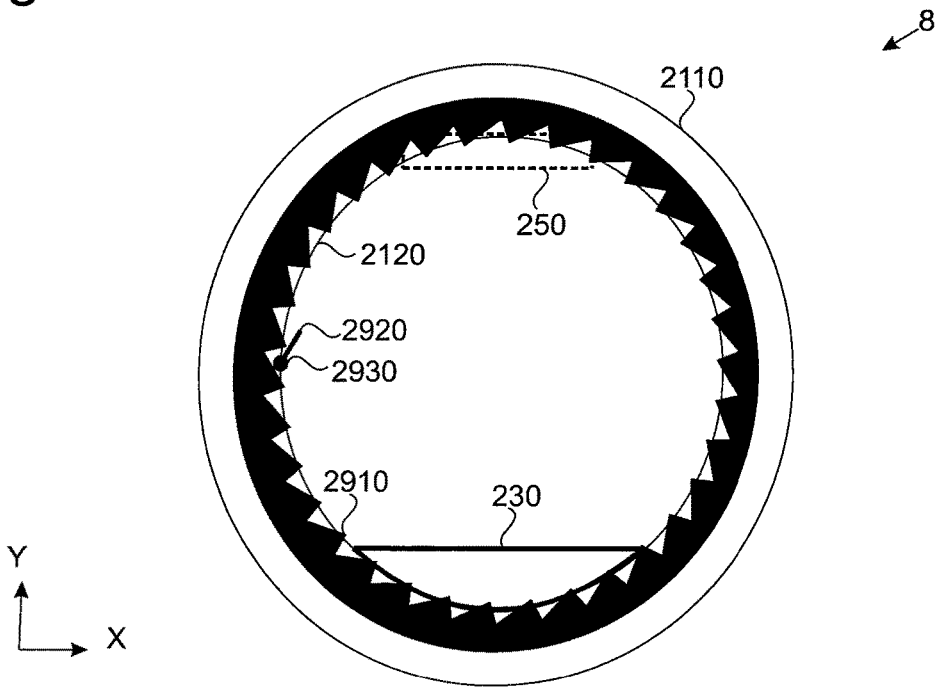

FIG. 9A schematically illustrates a roller skate 8 according to an embodiment of the invention projected on the plane Z-Y containing the axis of the wheel of the roller skate whereas FIG. 9B illustrates a side view of the same roller skate projected on the plane X-Y parallel to the plane containing the wheel and perpendicular to the plane of FIG. 9A.

The roller skate 8 comprises a free wheel system made through a sawtooth disc 2910 and an elastic return stopper

2920, 2930. Thanks to the free wheel system, it is possible to allow the rotation of the roller skate in a single direction.

In particular, the sawtooth disc 2910 is mounted in a substantially fixedly connected manner with the first circular element 2110 through, for example, fasteners schematically illustrated as 2911 and 2912, positioned on one side of the first circular element 2110 and connected to the sawtooth disc 2910. Thanks to such a construction, the sawtooth disc 2910 rotates substantially as a unit with the first circular element 2110.

The elastic return stopper 2920, 2930 is mounted in a substantially fixedly connected manner with respect to the second circular element 2120 and comprises a lever 2920 and an elastic return part on which the lever 2920 is mounted, schematically illustrated by reference numeral 2930. The elastic return part 2930 can be mounted directly on the second circular element 2120 through screws, glue or similar, or made in a single structure with the second circular element 2120. Alternatively, the elastic return part 2930 can be mounted in a substantially fixedly connected manner on the connection means 230.

In an alternative embodiment, the free wheel system can be inserted and disinserted, for example thanks to a locking system of the lever 2920 in a position such that the lever 2920 cannot come into contact with the sawtooth disc 2910. In a potential implementation, this could be obtained by foreseeing a locking pin of the lever 2920, not illustrated, or by making the spring act on the opposite side of the lever 2920 with respect to the point in which it is hinged, so that the spring acts so that it generates a separating movement of the lever 2920 away from the sawtooth disc 2910. When the lever is blocked or moved away, the free wheel system is disinserted, and when it is left free to act under the action of the elastic return part 2930, the free wheel system is inserted.

In a further alternative embodiment, the free wheel system can be inserted and disinserted through a remote control, in a similar manner to the remote control of the brake. Advantageously, the remote control of the free wheel system can be operated by an actuator mounted on the same element on which the actuator of the brake is mounted.

In a further alternative embodiment, the inner or outer edge of the disc of the brake 2820 could be sawtoothed and therefore act both as a brake disc and as a sawtooth disc 2910. In this way, a single disc could allow both functions to be obtained, saving weight.

Figure 10A:
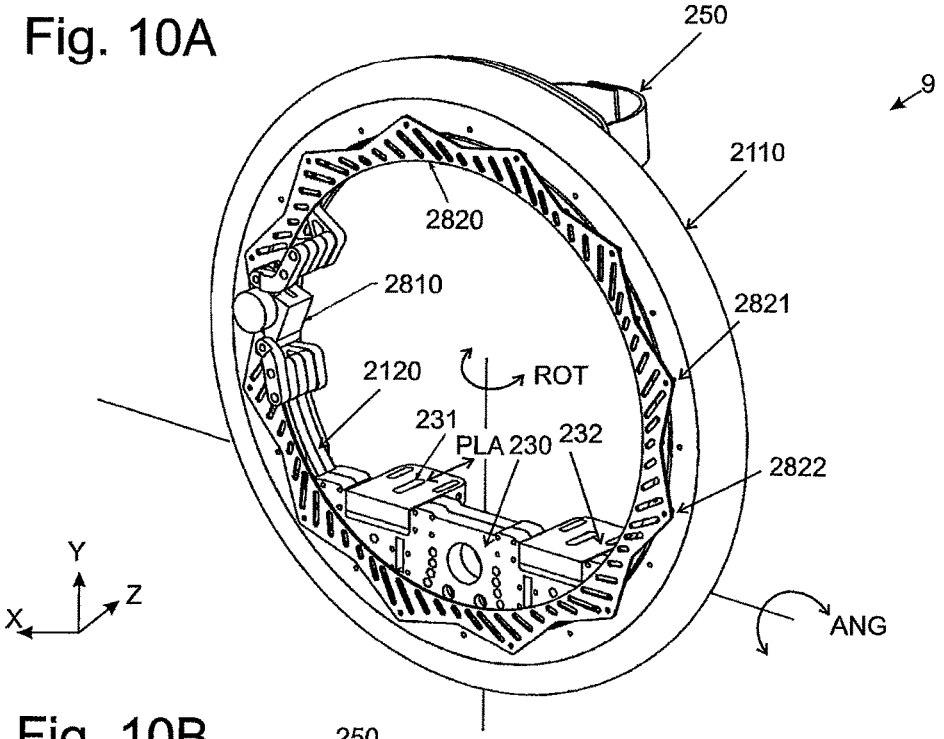
FIGS. 10A, 10B, 10C, and 10D schematically illustrate a roller skate according to an embodiment of the present invention.
Figure 10B:
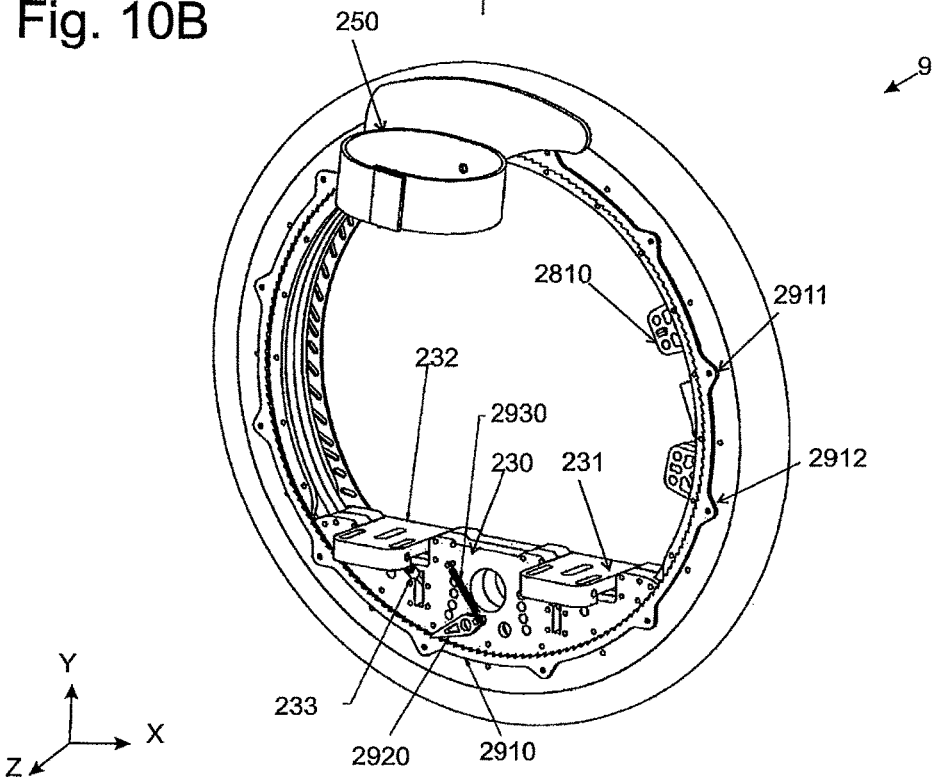
Figure 10C:
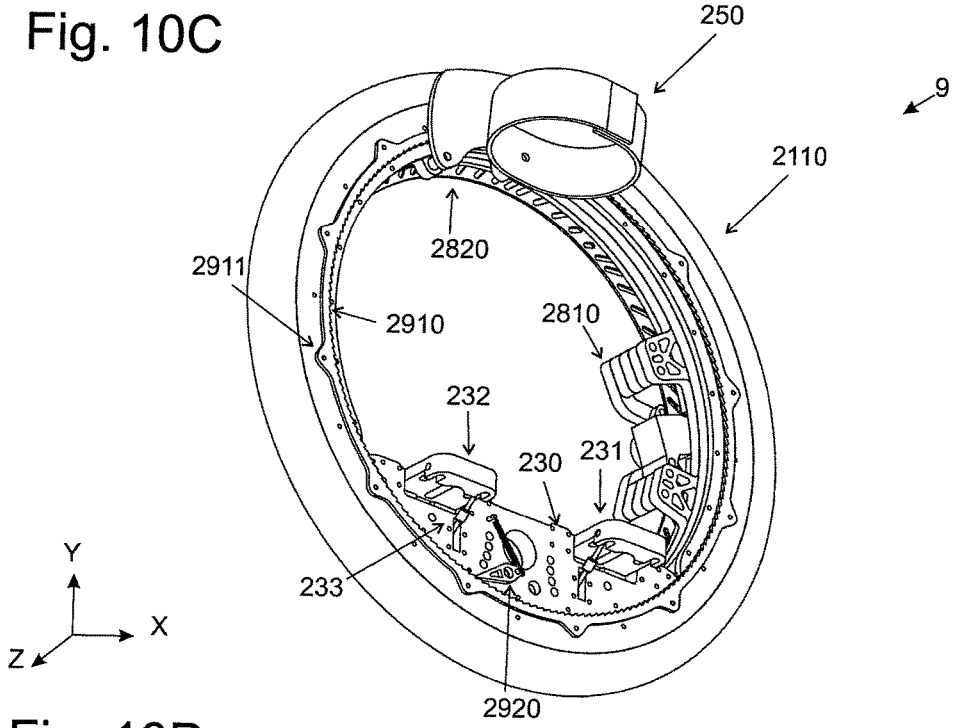
Figure 10D:
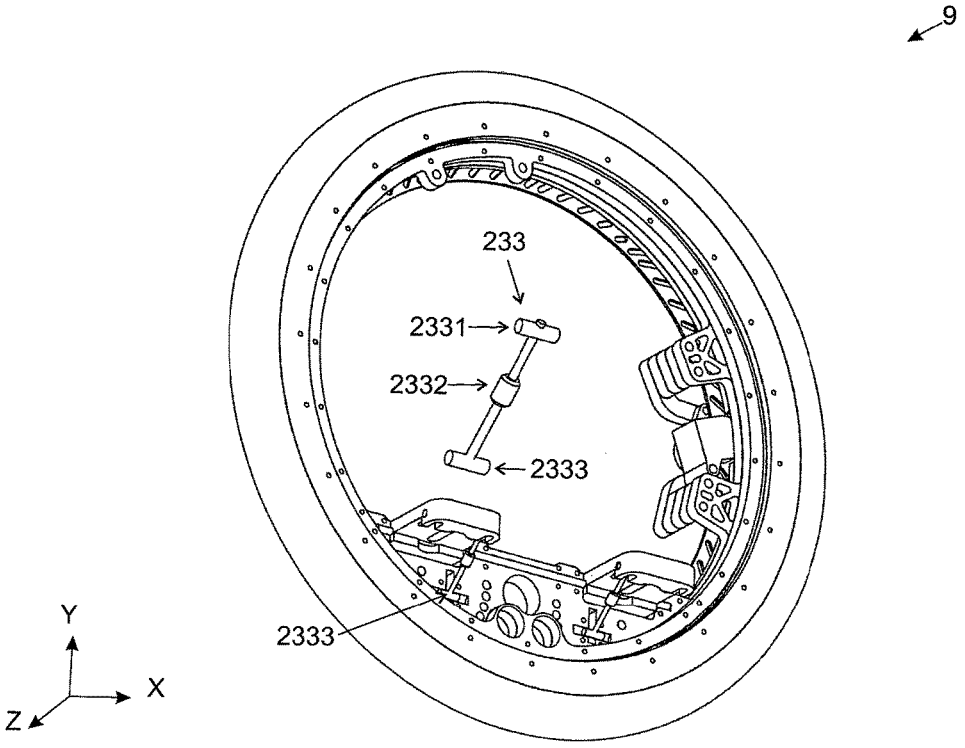

FIG. 10A schematically illustrates a roller skate 9 according to an embodiment of the invention seen in perspective whereas FIG. 10B illustrates a perspective view of the same roller skate 9, taken from the opposite direction with respect to that of FIG. 10A. FIGS. 10C and 10D illustrate the same roller skate 9, from the same side as FIG. 10B, but from a different angle.

As can be seen in FIGS. 10A and 10B, single characteristics of the roller skates 2-8 described earlier can be combined as desired in a single roller skate. As an example, the roller skate 9 includes the connection means 230 positioned at least partially inside the second circular element 2120, like in the roller skates 2-8. Moreover, the roller skate 9 includes a first circular element 2110 and a second circular element 2120, inside the first circular element 2110, as described for the roller skates 2-8. In addition, the roller skate 9 can include the ball system 2130, even if not illustrated, described for the roller skates 3-5. Moreover, the roller skate 9 includes the brake described for the roller skate 6 and the free wheel system described for the roller skate 8.

As an alternative with respect to the roller skates 2-10, the characteristics of which could in any case be combined with any one of the other roller skates described, the roller skate 9 illustrates a connection means 230 that includes two adjustable connection platforms 231 and 232.

The two connection platforms are such as to allow the connection of a shoe. For example, they can be equipped with threadings corresponding to screws present on the shoe. Alternatively, a quick hooking/release system as used in the pedals of bicycles can be implemented. Again as an alternative, a magnetic system involving magnets in at least one of the connection platforms 231 and 232, and/or in the shoe, can allow a quick fastening and release of the shoe to the connection platforms 231 and 232. In the last case it is preferably possible to provide at least one centring element of the shoe with respect to the connection means 230, for example a hole in the sole of the shoe that cooperates with a suitable pin in the connection means 230 and/or in the connection platforms 231, 232. In this way, the magnetic force will take care of preventing the shoe from moving away from the connection platforms 231 and 232 whereas the magnetic force and the pin can cooperate in preventing the shoe from sliding horizontally on the connection platforms 231 and 232.

As an alternative to the roller skates 3-5, the roller skate 9 offers the possibility of orienting the relative position of the connection platforms 231 and 232 with respect to the connection means 230 through an adjustment shaft 233.

In particular, as can be seen in FIG. 10C, the adjustment shaft 233 is connected, on one side, beneath the connection platforms 231 and 232 and on the other side to the connection means 230. More specifically, the connection platforms 231 and 232 are hinged on the connection means 230 on one side, and connected to the adjustment shaft on the other. In this way, by extending or shortening the adjustment shaft 233 it is possible to modify the position of the connection platforms 231 and 232, and more specifically their angle with respect to the connection means 230.

As can be seen in FIG. 10D, where an outer side of the connection means 230 is removed, and where the adjustment shaft is represented enlarged inside the roller skate, the control lever 233 has a T-shaped end 2333 that inserts in a suitable seat in the connection means 230. The other end 2331 of the adjustment shaft 233 inserts in a similar manner in the connection platforms. The modification of the length of the adjustment shaft 233 can be obtained by threading the ends on the outer barrels with left-handed threading on one side and right-handed on the other, so that rotating in one direction causes approach movement, and in the other direction movement away, of the outer edge of the connection platform. The double-threaded adjustment shaft is braked since on one side it also screws on a self-locking nut inserted on the platforms 231 and 232, in order to avoid accidental rotation during use of the roller skate.

As can be seen in FIG. 10A, in the roller skate 9 it is therefore possible to carry out the following adjustments. The translation or planar movement, of the shoe S on the central grooves of the elements 231-232 in a direction parallel to Z, represented by the arrow PLA. In this case, the means that connect the shoe S to the grooves can be of a size and configuration such as to allow them to move, in the adjustment step, inside the groove up to the desired point, to then proceed to lock, for example by screwing. It is also possible to adjust the angular position ANG with respect to the horizontal axis, parallel to X, through the adjustment shaft as described above. Finally, it is possible to adjust the rotation ROT with respect to the vertical axis parallel to Y, for example by making the grooves slightly wider than the screw that passes through them, and that, in an example embodiment, screws into the shoe locking it in position by friction.

Figure 11A:
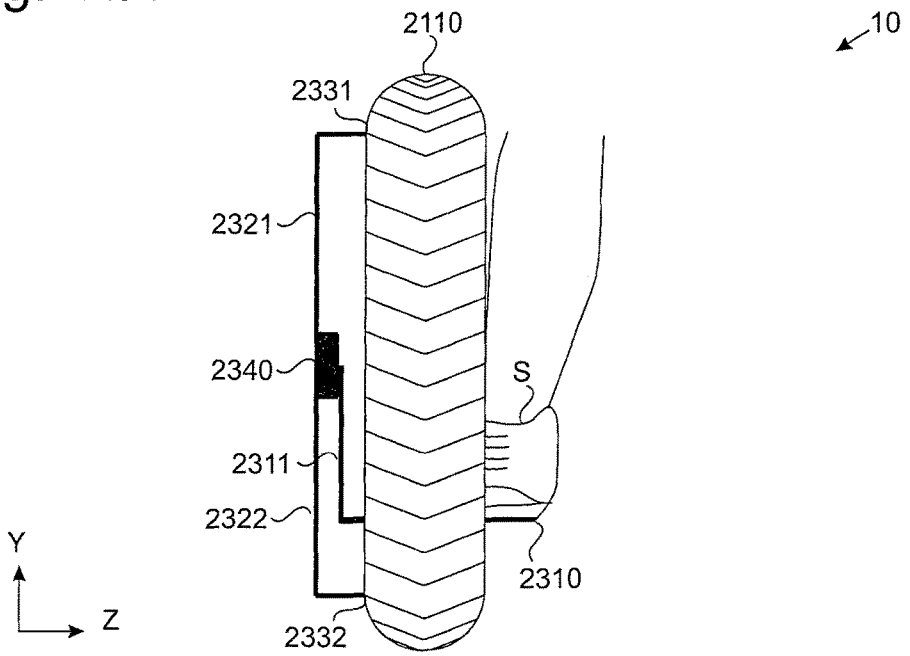
FIGS. 11A and 11B schematically illustrate a roller skate according to an embodiment of the present invention.
Figure 11B:
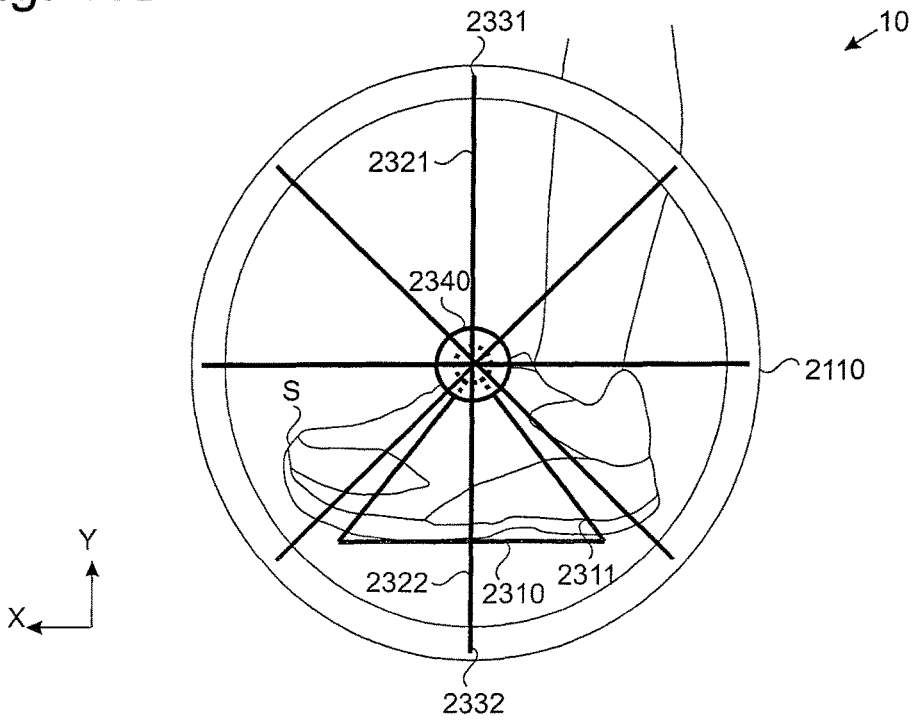

FIG. 11A schematically illustrates a roller skate 10 according to an embodiment of the invention projected on the plane Z-Y containing the axis of the wheel of the roller skate whereas FIG. 11B illustrates a side view of the same roller skate projected on the plane X-Y parallel to the plane containing the wheel and perpendicular to the plane of FIG. 11A.

In this embodiment, the connection means of the shoe S to the roller skate 10 comprises at least two elements, one horizontal 2310 and one vertical 2311. Preferably, more vertical elements 2311 can be used to offer better rigidity of the structure. Again preferably, the horizontal element can be configured in a similar manner to the roller skates 2-9, thus including connection elements to the shoe S, which allow the positioning of the shoe S in a manner that can be configured with respect to the horizontal element 2310.

The connection means is connected to a side, inner or outer respectively, of a bearing 2340, whereas the remaining side of the bearing, outer or inner respectively, is connected to spokes 2321, 2322, in turn connected to the first circular element 2110 through connections 2332, 2331. In this configuration, the part of the bearing to which the vertical part 2311 of the connection element is connected can be compared, by analogy, to the second circular element 2120 described earlier, since it is connected in a substantially fixed manner to the connection element, whereas it is connected in a rotatable manner to the first circular element 2110.

Also in this embodiment, the shoe S can be advantageously positioned, at least partially, inside the plane of the wheel, thanks to an arrangement of the spokes 2321, 2322 externally with respect to the plane of the wheel. In other words, the shoe S can be advantageously positioned at least partially inside the wheel, even though the wheel is a spoked wheel, thanks to the positioning of the spokes outside of the plane defined by the wheel. Like in the previous cases, this allows the weight of the user to be positioned advantageously with respect to the point of contact between wheel and ground.

It will be clear that the characteristics of the roller skates 2-10, even though they have been described independently with the purpose of making them easier to illustrate and describe, can be combined with each other freely.

In the above description, reference has been made to a roller skate with a single wheel in which the connection means 230 is configured so as to position the shoe S at least partially inside the first circular element 2110. However, the present invention is not limited to this configuration.

In an alternative embodiment of the present invention, the connection means 230 can be made so as to allow the weight of the user to be discharged close to the point of contact between wheel and ground without however requiring the positioning of at least part of the shoe inside the first circular element 2110. The positioning of the shoe at least partially inside the first circular element 2110 is a way to discharge the weight of the user in an advantageous manner. The present invention also covers alternative ways of obtaining such a result.

In some embodiments, the connection element 230 has a positive angle, measured in the clockwise direction with respect to the direction Z, on the plane y-z illustrated in FIG. 2A thanks to which the direction perpendicular to the horizontal upper surface of the connection element 230 has a positive angle, measured in the clockwise direction with respect to the direction Y illustrated in FIG. 2A such that it is possible to discharge the weight of the user close to the point of contact between the second circular element 2120 and the ground.

In other words, thanks to the positive angle, measured in the clockwise direction, between the horizontal upper surface of the connection means 230 and the direction Z, the user will tend to position the roller skate so as to place the base of the shoe S, and therefore the horizontal upper surface of the connection means 230, in a substantially horizontal position (parallel to the axis Z). This will lead to the plane containing the wheel of the roller skate taking up a negative angle, measured in the clockwise direction with respect to the direction Y. This results in bringing the point of contact between the second circular element 2110 and the ground and the crossing point between the vertical passing through the connection means 230 and the ground closer together.

In other words again, the movement closer together of the point of contact of the circular element 2110 and the ground and the point at which the weight force vector deriving from the leg of the user meets the ground can be obtained by taking the shoe outside of the plane of the wheel and tilting the wheel with respect to the connection means 230 in a suitable manner.

Figure 1A:
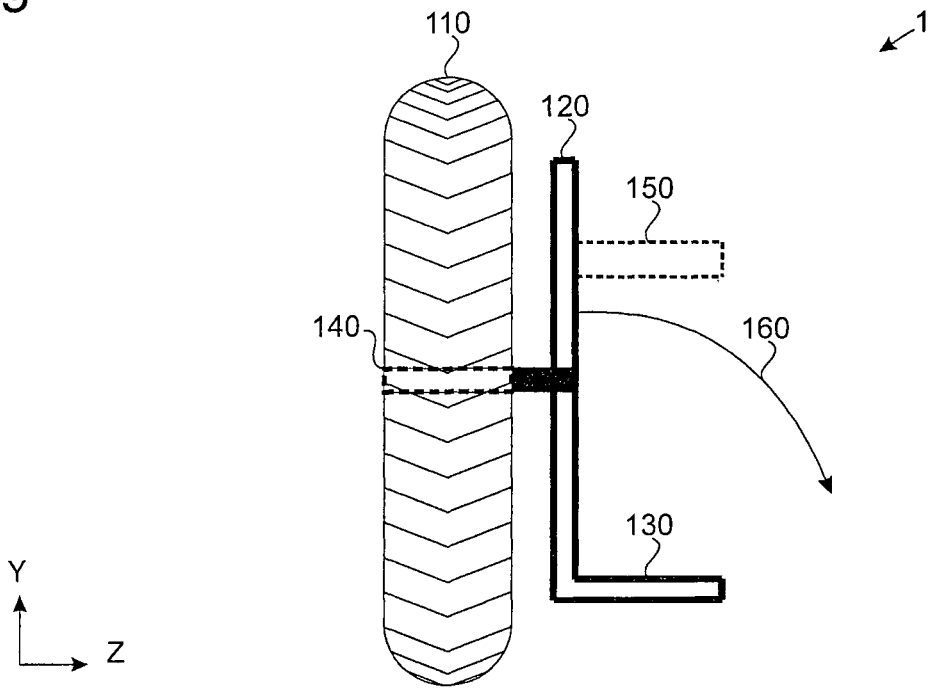
FIGS. 1A and 1B schematically illustrate a roller skate according to the state of the art.
Figure 1B:
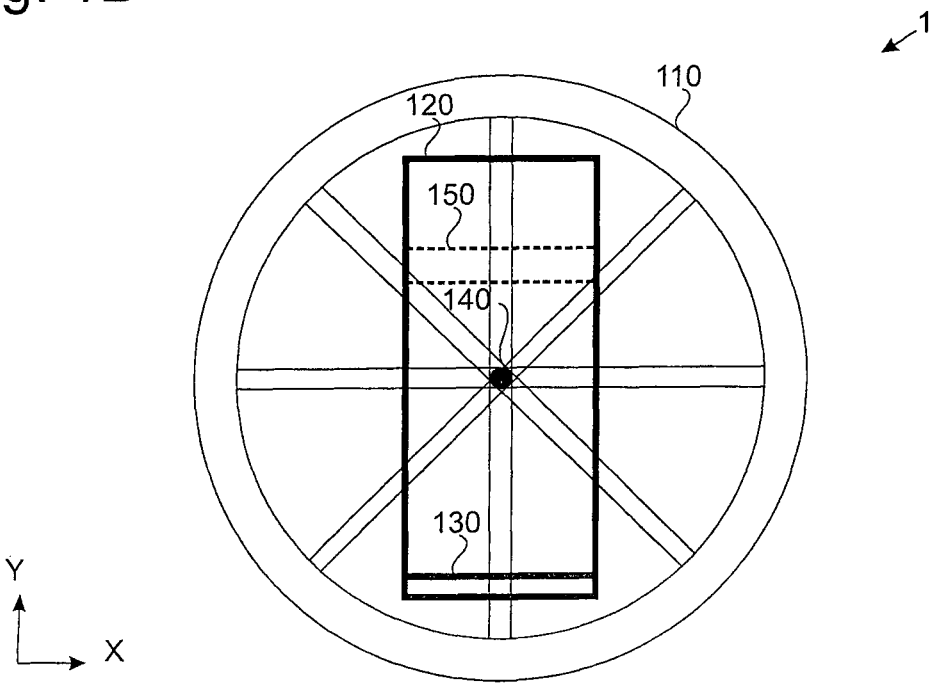

It is therefore possible to bring the point on the ground on which the weight of the user is projected closer towards the point of contact between wheel and ground, so as to avoid or at least reduce the force schematically illustrated by the arrow 160 in FIG. 1A.

It is not necessary for the angle provided to the connection means 230 to be such as to perfectly match up the crossing point between the vertical passing through the connection means 230 and the ground with the point of contact between the second circular element 2120 and the ground. In order to obtain easier use of the roller skate and so as to reduce the inconvenience caused by the force schematically illustrated by the arrow 160 in FIG. 1A, it is sufficient for an angle to the connection means 230 to be provided so as to bring the crossover point between the vertical passing through the connection means 230 and the ground closer with the point of contact between the second circular element 2110 and the ground, with respect to the case illustrated in FIG. 1A. In some embodiments, an angle comprised between 1 and 20 can be implemented.

In another alternative embodiment of the present invention, it is possible to bring the crossover point between the vertical passing through the connection means 230 and the ground closer together with the point of contact between the second circular element 2120 and the ground, without the connection means 230 having an angle with respect to the direction Z as described earlier. This is possible by distancing the stabilization means 250 from the second circular element 2120. In this way, the leg of the user is forced to be arranged with a positive angle, measured in the clockwise direction, with respect to the direction Y. This positioning obtains advantageous effects similar to those described in relation to the previous embodiment, in particular bringing the crossover point between the vertical passing through the connection means 230 and the ground closer together with the point of contact between the second circular element 2110 and the ground, with respect to the case illustrated in FIG. 1A.

In a further embodiment, the two solutions described in the two previous embodiments, i.e. the implementation of an angle between the horizontal upper surface of the connection means 230 and the direction Z, as well as taking the stabilization means 250 away from the second circular element 2120, can also be advantageously combined. Moreover, in alternative embodiments, one or both of the two previous embodiments can be combined with a connection means 230 as described in relation to FIG. 2A, in particular configured so as to position the shoe S at least partially inside the first circular element 2110.

It is therefore clear that the present invention should not be considered limited to the case in which the connection means 230 is configured so as to position the shoe S inside the first circular element 2110.

Moreover, the present invention can be implemented in embodiments in which the connection means 230 is not configured so as to position the shoe S inside the first circular element 2110, and the two alternative solutions consisting of the use of an angle for the horizontal upper surface of the connection means 230 or of distancing the stabilization means 250 from the second circular element 2120 are not implemented. In such embodiments, the moment schematically illustrated by the arrow 160 in FIG. 1A is considered acceptable and the invention solves additional problems. In general, all of the embodiments described with reference to FIGS. 4A to 10D can be implemented also in this case, i.e. in the case in which the connection means 230 positions the shoe externally, with respect to the first circular element 2110 and the contact point between element 2110 and ground is not close to the point at which the weight force of the user through the leg reaches the ground or even in the case in which the leg is almost parallel to the plane of the wheel or in whatever way the shoe is positioned with respect to the plane of the wheel.

In particular, the embodiment described with reference to FIGS. 4A and 4B can obtain the advantage of allowing sliding between the first circular element 2110 and the second circular element 2120 through the insertion of balls 2130, as rolling elements, irrespective of the specific configuration of the connection means 230 and/or of the stabilization means 250. In a similar way, the embodiment illustrated in FIGS. 4C and 4D allows the reduction of the friction between the first circular element 2110 and the second circular element 2120 irrespective of the specific configuration of the connection means 230 and/or of the stabilization means 250.

In an analogous manner, the embodiments described with reference to FIGS. 5A, 5B, 6A and 6B allow the advantageous adjustment of the connection means 230, in order to allow an adaptation to every user, irrespective of the way in which the connection means 230 positions the shoe S with respect to the first circular element 2110.

Again in a similar way, the embodiments described with reference to FIGS. 7A, 7B and 8 allow effective and/or facilitated braking and/or facilitated use to be obtained thanks to the presence of the brake and/or thanks to the actuators 2840, 2850 optionally assembled on a rod 2841, irrespective of the way in which the connection means 230 positions the shoe S with respect to the first circular element 2110, irrespective of the specific configuration of the connection means 230 and/or of the stabilization means 250.

In particular, an embodiment of the present invention can therefore also refer to a roller skating system comprising a roller skate with a single wheel, the roller skate with a single wheel comprising: a wheel; a connection means configured so as to allow the connection of a shoe; characterized in that the wheel comprises a first circular element and a second circular element, inside the first circular element, between the first circular element and the second circular element a rolling element being arranged, configured so as to facilitate the relative movement of the first circular element with respect to the second circular element; the connection means is connected to the second circular element, and by a brake, where the brake comprises a first braking element connected to the first circular element and a second braking element connected to the second circular element and the braking action is obtained by the friction between the first braking element and the second braking element, and in that the roller skating system also comprises an actuator for the brake, in which the actuator is configured so as to be operated remotely, preferably by hand, by the user of the roller skating system; and a rod, preferably used by the user of the roller skating system in order to aid him/herself during the use of the roller skating system, where the actuator is mounted on the rod, preferably at one end and/or at a gripping point thereof.

Similarly, the embodiment described with reference to FIGS. 9A and 9B makes it possible to obtain the advantages deriving from the free wheel and from the other characteristics of the embodiments described with reference to FIGS. 10A to 10D, irrespective of the way in which the connection means 230 positions the shoe S with respect to the first circular element 2110, irrespective of the specific configuration of the connection means 230 and/or of the stabilization means 250.

The invention claimed is:

1. A roller skate (2-10) with a single wheel comprising:

a connection device (230) configured so as to allow the connection of a shoe (S) and a wheel, wherein the wheel comprises (a) a first circular element (2110) and a second circular element (2120) positioned inside the first circular element (2110), (b) a rolling element (2130) arranged between the first circular element (2110) and the second circular element (2120) so as to facilitate the relative movement of the first circular element (2110) with respect to the second circular element (2120), and the connection device (230) is connected to the second circular element (2120) and is configured so as to position a shoe (3) at least partially inside the first circular element (2110), and a free wheel system, the free wheel system comprising a sawtooth disc (2910) and at least one elastic return stopper (2920, 2930).

2. The roller skate according to claim 1, wherein the connection device (230) and the second circular element (2120) are configured so as to position a shoe (3) at least partially inside the second circular element.

3. The roller skate according to claim 1, wherein the rolling element (2130) comprises balls, rollers, ball-bearings or roller bearings.

4. The roller skate according to claim 1, further comprising a first configuration device (2710) and/or a second configuration device (2720), wherein the first configuration device (2710) and/or the second configuration device (2720) is configured so as to allow a planar movement of the connection means (230) with respect to the second circular element (2120) and the connection device (230) is connected to the second circular element (2120) through the first configuration device (2710) and/or the second configuration device (2720).

5. The roller skate according to claim 4, further comprising a third configuration device (2760, 2761), wherein the third configuration device (2760, 2761) is configured so as to allow an angular movement of the connection device (230) with respect to the second circular element (2120) and the connection device (230) is connected to the second circular element (2120) through the third configuration device (2760, 2761).

6. The roller skate according to claim 1, further comprising a brake (2810, 2820), wherein the brake comprises a first braking element (2820) connected to the first circular element (2110) and a second braking element (2810) connected to the second circular element (2120), and a braking action is obtained by friction between the first braking element and the second braking element.

7. A roller skating system comprising the roller skate according to claim 6 and an actuator (2840, 2850) for the brake, wherein the actuator (2840, 2850) is configured so as to be operated remotely.

8. The roller skating system according to claim 7 further comprising a rod (2841), wherein the actuator (2840, 2850) is mounted on the rod (2841).

9. The roller skate according to claim 1 further comprising a brake (2810, 2820), wherein the brake comprises a first braking element (2820) connected to the first circular element (2110) and a second braking element (2810) connected to the second circular element (2120), and a braking action is obtainable by friction between the first braking element and the second braking element and the sawtooth disc (2910) and the first braking element (2820) are made from a single element.

10. A roller skating system comprising a roller skate (2-10) with a single wheel, the roller skate comprising:

a connection device (230) configured so as to allow the connection of a shoe (S) and a wheel (2110, 2120), wherein the wheel comprises (a) a first circular element (2110) and a second circular element (2120) positioned inside the first circular element (2110), and (b) a rolling element (2130) arranged between the first circular element (2110) and the second circular element (2120) so as to facilitate the relative movement of the first circular element (2110) with respect to the second circular element (2120), wherein the connection device (230) is connected to the second circular element (2120), the roller skate further comprises a brake (2810, 2820) comprising a first braking element (2820) connected to the first circular element (2110) and a second braking element (2810) connected to the second circular element (2120), wherein a braking action is obtainable by friction between the first braking element and the second braking element, an actuator (2840, 2850) for the brake, wherein the actuator (2840, 2850) is configured so as to be operated remotely, and a rod (2841), wherein the actuator (2840, 2850) is mounted on the rod (2841).

* * * * *